US009817343B2

(12) United States Patent
Takeda

(10) Patent No.: US 9,817,343 B2
(45) Date of Patent: Nov. 14, 2017

(54) FIXING APPARATUS HAVING FILM, HEATER, AND SHIELDING MEMBER HAVING A CUTOUT AND MOVABLE BETWEEN A FIRST POSITION AND A SECOND POSITION SO THAT RADIANT LIGHT EMITTED THROUGH THE CUTOUT HEATS THE FILM

(71) Applicant: CANON KABUSHIKI KAISHA, Tokyo (JP)

(72) Inventor: Masami Takeda, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/958,044

(22) Filed: Dec. 3, 2015

(65) Prior Publication Data

US 2016/0170339 A1 Jun. 16, 2016

(30) Foreign Application Priority Data

Dec. 10, 2014 (JP) ..... 2014-249942

(51) Int. Cl.
*G03G 15/20* (2006.01)

(52) U.S. Cl.
CPC ..... *G03G 15/2017* (2013.01); *G03G 15/2007* (2013.01); *G03G 15/2053* (2013.01); *G03G 2215/2035* (2013.01)

(58) Field of Classification Search
CPC ..... G03G 15/2003; G03G 15/20; G03G 15/2007; G03G 15/2078; G03G 15/2082; G03G 15/2017; G03G 15/2053; G03G 2215/2035
USPC ..... 399/329, 328, 335, 336
See application file for complete search history.

(56) References Cited

U.S. PATENT DOCUMENTS

| | | | | |
|---|---|---|---|---|
| 7,251,447 | B2 | 7/2007 | Kanamori et al. | |
| 7,881,650 | B2 | 2/2011 | Shin et al. | |
| 8,032,069 | B2 | 10/2011 | Shin et al. | |
| 2009/0092423 | A1 | 4/2009 | Shin et al. | |
| 2010/0067929 | A1 * | 3/2010 | Seki | G03G 15/2042 399/45 |

(Continued)

FOREIGN PATENT DOCUMENTS

| | | | |
|---|---|---|---|
| JP | 60118871 | A * | 6/1985 |
| JP | 2006098475 | A * | 4/2006 |

(Continued)

*Primary Examiner* — Billy Lactaoen
(74) *Attorney, Agent, or Firm* — Fitzpatrick, Cella, Harper and Scinto

(57) ABSTRACT

The fixing apparatus includes a cylindrical film, a nip portion forming member in contact with the film, a pressure member that forms the nip portion with the nip portion forming member through the film, a heater configured to heat the film by emitting a radiant light, the heater being arranged in a hollow portion of the film, a first shielding member arranged between the nip portion forming member and the heater, and a second shielding member movable between a first position in which the second shielding member is positioned in a region between the first shielding member and the nip portion forming member, and a second position in which the second shielding member is positioned in a region, where the nip portion forming member does not exist, between the heater and the film. The second shielding member has a slit through which the radiant light passes.

9 Claims, 28 Drawing Sheets

(56) References Cited

U.S. PATENT DOCUMENTS

| | | | | |
|---|---|---|---|---|
| 2010/0158587 | A1* | 6/2010 | Shin | G03G 15/2039 399/329 |
| 2011/0091254 | A1 | 4/2011 | Shin et al. | |
| 2013/0121737 | A1* | 5/2013 | Keino | G03G 15/2017 399/329 |

FOREIGN PATENT DOCUMENTS

| | | | |
|---|---|---|---|
| JP | 2006267420 | A | * 10/2006 |
| JP | 2009-093141 | A | 4/2009 |

* cited by examiner

< EXAMPLE OF TEMPERATURE RISE AT EDGE PORTION OF 24 ppm APPARATUS: TEMPERATURE DISTRIBUTION AFTER CONTINUOUS FEEDING OF 10 ENVELOPES >

< EXAMPLE OF TEMPERATURE RISE AT EDGE PORTION OF 40 ppm APPARATUS: TEMPERATURE DISTRIBUTION AFTER CONTINUOUS FEEDING OF 10 ENVELOPES >

< MEASURE AGAINST TEMPERATURE RISE AT EDGE PORTION OF 24 ppm APPARATUS: COMPARISON OF TEMPERATURE DISTRIBUTION AFTER CONTINUOUS FEEDING OF 10 ENVELOPES >

< MEASURE AGAINST TEMPERATURE RISE AT EDGE PORTION OF 24 ppm APPARATUS/ COMPARISON OF TEMPERATURE DISTRIBUTION AFTER CONTINUOUS FEEDING OF 10 SHEETS OF B5 PAPER >

< MEASURE AGAINST TEMPERATURE RISE AT EDGE PORTION OF 24 ppm APPARATUS/ COMPARISON OF TEMPERATURE DISTRIBUTION AFTER CONTINUOUS FEEDING OF 10 SHEETS OF A5 PAPER >

FIXING APPARATUS HAVING FILM, HEATER, AND SHIELDING MEMBER HAVING A CUTOUT AND MOVABLE BETWEEN A FIRST POSITION AND A SECOND POSITION SO THAT RADIANT LIGHT EMITTED THROUGH THE CUTOUT HEATS THE FILM

BACKGROUND OF THE INVENTION

Field of the Invention

The present invention relates to a fixing apparatus to be mounted in an electrophotographic image forming apparatus.

Description of the Related Art

Hitherto, in electrophotographic image forming apparatus such as a printer, a copying machine, and a facsimile machine, toner images are formed on recording materials by an electrostatic image forming unit, and then the recording materials are heated and pressurized by a fixing apparatus, to thereby melt and fix the toner images onto the recording materials. In recent years, there has been proposed and put into the market a film heating fixing apparatus as disclosed, for example, in Japanese Patent Application Laid-Open No. 2009-93141, which includes a halogen heater serving as a heater unit thereof so that a film member (fixing film) is heated with the radiation heat of the halogen heater.

In the fixing apparatus disclosed in Japanese Patent Application Laid-Open No. 2009-93141, in a fixing nip portion-forming region of the fixing film, an inner surface of the film can be heated with the radiation heat of the halogen heater. In addition, also on a side opposite to the fixing nip portion (counter-fixing nip side), radiant light can be emitted onto the inner surface of the film. In other words, the temperature in a region on the counter-fixing nip side of the fixing film is raised in advance before the region comes to the fixing nip portion. This configuration is expected to shorten the time period required to raise the temperature of the fixing film.

In the configuration of the related art described above, from a viewpoint of allowing the emission of the radiant light, it is preferred that a shielding object not be interposed between the heater and the fixing film in the region on the counter-fixing nip side if possible. However, in such a configuration, when the fixing film is deformed for some reason, the inner surface of the fixing film and the heater may come into contact with each other. As a result, various kinds of trouble may occur.

Specifically, there has been known a phenomenon in which a leading edge of the recording material that has rolled around the fixing film is caught, for example, in a thermistor in the fixing unit, and is deformed into a zigzag shape (accordion jam). When conditions to cause the fixing film and the leading edge portion of the recording material to be more forcefully pressed against each other are met, specifically, when the toner images have been formed without a margin at the leading edge portion at a time point when the recording material enters the fixing nip portion, the recording material is conveyed while rolling around the fixing film. As a result, an accordion jam occurs. When an accordion jam occurs, an outer surface of the fixing film may be pushed by the creased recording material, with the result that the inner surface thereof may be deformed to come into contact with the heater. In many cases, lubricating grease is applied to the inner surface of the fixing film. Thus, when the fixing film comes into contact with the heater, a surface of the heater may be fouled with the grease or impurities.

Further, when a significant external force is applied to the fixing film, the heater may even be damaged.

In addition, a problem called an edge portion temperature rises is known, i.e., regions at both edge portions of the fixing film are locally and excessively heated in a width direction of the recording material when the size (width) of the recording material is smaller than the temperature raised regions of the fixing film at the time of, for example, fixing the toner images on small size sheets. As in fixing apparatus of other types, effective measures against this problem have still been investigated in the film heating fixing apparatus of the halogen-heater type.

SUMMARY OF THE INVENTION

According to one exemplary embodiment of the present invention, there is provided, a fixing apparatus for fixing a toner image onto the recording material while conveying the recording material bearing the toner image at a nip portion. The fixing apparatus includes a cylindrical film, a nip portion forming member in contact with an inner surface of the film, a pressure member configured to form the nip portion with the nip portion forming member through the film, a heater configured to heat the film by emitting radiant light, the heater being arranged in a hollow portion of the film, a first shielding member arranged between the nip portion forming member and the heater, and a second shielding member configured to be movable between a first position in which the second shielding member is positioned in a region between the first shielding member and the nip portion forming member, and a second position in which the second shielding member is positioned in a region, where the nip portion forming member does not exist, between the heater and the film. The second shielding member has a slit through which the radiant light passes.

Further features of the present invention will become apparent from the following description of exemplary embodiments with reference to the attached drawings.

DESCRIPTION OF THE EMBODIMENTS

Now, exemplary embodiments of the present invention are described in detail with reference to the drawings. Note that, the dimensions, the materials, and the shapes of components described in the embodiments, the relative arrangement thereof, and other such factors may be appropriately changed depending on structures of apparatus to which the present invention is applied or various conditions. In other words, the scope of the present invention is not intended to be limited to the following embodiments.

<First Embodiment>

(Image Forming Apparatus)

Figure 1:
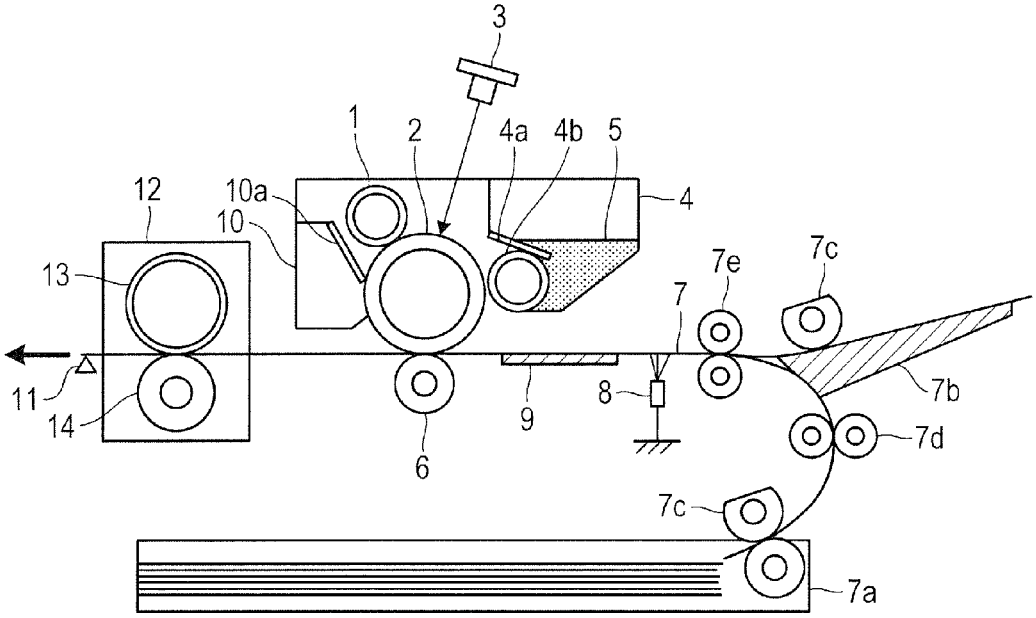
FIG. 1 is a schematic sectional view for illustrating an overall configuration of an image forming apparatus according to embodiments of the present invention.

FIG. 1 is a schematic sectional view for illustrating a basic configuration of an image forming apparatus according to embodiments of the present invention. In the embodiments, a case where the present invention is applied to an electrophotographic monochromatic printer as the image forming apparatus is described.

In the image forming apparatus according to the embodiments of the present invention, a surface of a photosensitive drum 2 is uniformly charged by a charging roller 1 to a predetermined polarity. Then, the photosensitive drum 2 is exposed by an exposure unit 3 such as a laser, and only the exposed regions of the photosensitive drum 2 are destaticized. In this way, a latent image (an electrostatic latent image) is formed on the photosensitive drum 2. This latent image is developed as follows. Toner 5 in a developing unit 4 is triboelectrically charged between a developing blade 4*a* and a developing sleeve 4*b* so as to have the same polarity as that of the surface of the photosensitive drum 2, and is then conveyed to an opposing portion between the photosensitive drum 2 and the developing sleeve 4*b*. Next, a DC bias and an AC bias are applied to the toner 5 in a superimposed manner so as to generate an electric field effect, to thereby float and vibrate the toner 5. Along with rotation of the photosensitive drum 2, a toner image part formed by causing the toner to selectively adhere to the photosensitive drum 2 is conveyed to a transfer nip portion formed between a transfer roller 6 and the photosensitive drum 2. Note that, as the developing method described above, there may be employed not only the non-contact method described above, but also a contact developing method in which the DC bias is applied while an elastic developing roller is held in contact with the photosensitive drum 2 so as to cause the toner 5 to selectively adhere to a latent image forming portion of the photosensitive drum 2.

Meanwhile, a recording material 7, such as a sheet to be subjected to image recording, is fed from a recording material storage box 7*a* by a sheet feeding roller pair 7*c* up to a point where a leading edge portion of the recording material 7 reaches a perpendicular conveying roller pair 7*d*. Then, the recording material 7 is conveyed to a pre-transfer conveying roller pair 7*e* by the perpendicular conveying roller pair 7*d*. Alternatively, the recording material 7 may be conveyed from a manual feeding tray 7*b* to the pre-transfer conveying roller pair 7*e* by another sheet feeding roller 7*c*. The recording material 7 is conveyed into the transfer nip portion at a preset entry angle along a transfer guide plate 9 by the pre-transfer conveying roller pair 7*e*. During the conveyance, a destaticizing brush 8 configured to remove unnecessary charge on a surface of the recording material 7 is applied to a back surface side of the recording material 7 so as to destaticize the recording material 7. After the destaticization, the recording material 7 is conveyed into the transfer nip portion. In the transfer nip portion, in order to cause the toner 5 on the photosensitive drum 2 to be electrostatically attracted onto the recording material 7, a high voltage of a polarity reverse to the polarity of the toner 5 is applied to the transfer roller 6 on the back surface side of the recording material 7. Specifically, a transfer electric charge is applied to the back surface of the recording material 7 through the intermediation of the transfer roller 6 so that the back surface of the recording material 7 is charged to the polarity that is the reverse of the polarity of the toner 5, to thereby retain the toner 5.

Lastly, the recording material 7 having the toner image transferred thereon is conveyed to a fixing nip portion formed between an outer peripheral surface of a fixing film 13 serving as a heat rotary member in a fixing apparatus 12, and an outer peripheral surface of the pressure roller 14. In the fixing nip portion, the fixing film 13 is subjected to constant temperature control by a constant temperature control unit (not shown) so that a preset fixing temperature is maintained. In this state, the recording material 7 is heated and pressurized so that the toner image is fixed onto the recording material 7. In this way, the image forming process is performed. The components used in the image forming process until the formation of the unfixed toner image in the configuration described above correspond to an image forming unit of the present invention. Further, in this embodiment, a discharge sensor 11, serving as a detection unit configured to detect whether or not a jam occurs in the fixing apparatus 12, is arranged on a downstream side with respect to the fixing apparatus 12. When the discharge sensor 11 does not detect the presence of the recording material 7 that is supposed to pass through the fixing apparatus 12 in a series of the image forming sequences, it is determined that a jam has occurred, and a jam occurrence signal is transmitted to a CPU serving as a control unit.

Note that, a small amount of adhering substance having a reverse polarity, such as toner particles, remains on the surface of the photosensitive drum 2 after the transfer of the toner image. Thus, in a cleaning container 10, a cleaning blade 10*a* is brought into abutment in a counter direction against the surface of the photosensitive drum 2, which has passed through the transfer nip portion, to thereby scrape off the adhering substance on the surface. In this way, the photosensitive drum 2 is cleaned, and waits for a subsequent image formation.

The process described above is executed in the case of using a monochromatic toner. In a case of a color printer that uses a plurality of color toners, a plurality of color toner images are developed onto a single photosensitive drum, or a color image is formed by superimposing the toners of the plurality of colors onto a plurality of photosensitive drums, the number of which are the same as the number of colors of the toners. Further, in the color printer, various transfer methods for forming the toner images onto the recording material may be employed, such as a method of transferring toner images in a superimposed manner onto an intermediate transfer belt, and then secondarily transferring those toner images collectively onto a recording material, and a method of transferring toner images in a superimposed manner onto a recording material that is conveyed while being attracted by a transfer belt. All of those transfer methods are common to each other in that printing is finished by the fixing apparatus configured to pressurize and heat the toner, to thereby permanently fix, onto the recording material, the toner image transferred on the recording material.

(The Fixing Apparatus of Related Art)

With reference to FIG. 2A to FIG. 2D, FIG. 3A and FIG. 3B, FIG. 4A to FIG. 4D, and FIG. 5A and FIG. 5B, a film heating fixing apparatus of a halogen-heater type and technical problems therewith are described, as a related art.

Figure 2A:
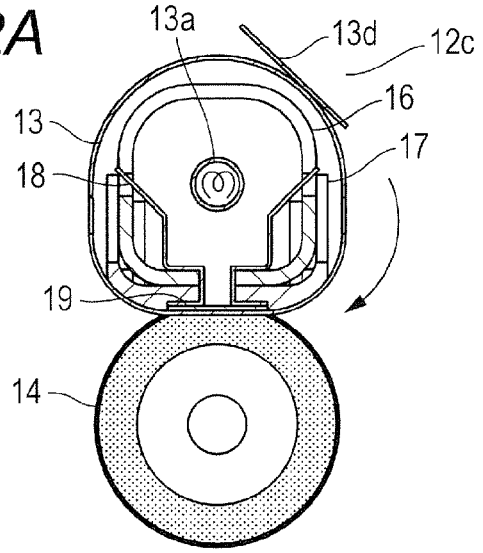
FIG. 2A, FIG. 2B, FIG. 2C and FIG. 2D are explanatory views for illustrating a film heating fixing apparatus of a halogen-heater type as a configuration of a related art.

FIG. 2A is a sectional view for illustrating a film heating fixing apparatus 12*c* of the halogen-heater type as a related art. The fixing apparatus 12*c* includes a halogen heater 13*a*, the fixing film 13, a metal pressure stay 16, a film guide 17, a heat shielding member 18, and a pressure sliding plate 19. The fixing film 13 serving as a pressure rotary member is formed of a thin metal film member, specifically, a fixing film having a blackened inner surface formed through the application of a heat resistant black coating or through film oxidation for enhancing the an efficiency in absorbing radiant light (radiation heat) of the halogen heater 13*a*.

Figure 2B:
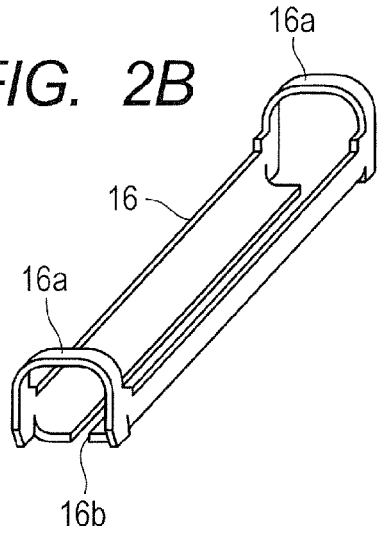

FIG. 2B is a perspective view for illustrating the metal pressure stay 16. In order to allow the radiant light of the halogen heater 13*a* to be more efficiently passed onto the inner surface of the fixing film 13, an upper half of a central portion of the stay 16 is cut out and opened except for parts overlapping with the film guide 17 formed over an upstream side and a downstream side with respect to the fixing nip portion, and for arch portions 16*a* at end portions in a longitudinal direction of the stay 16. Further, a pressure portion is formed of flat surface portions of bent portions of a bottom surface of the stay 16, which are bent toward a nip center, and a slit portion 16*b* is formed at a nip central portion along the longitudinal direction by a clearance between the bent portions facing each other.

Figure 2C:
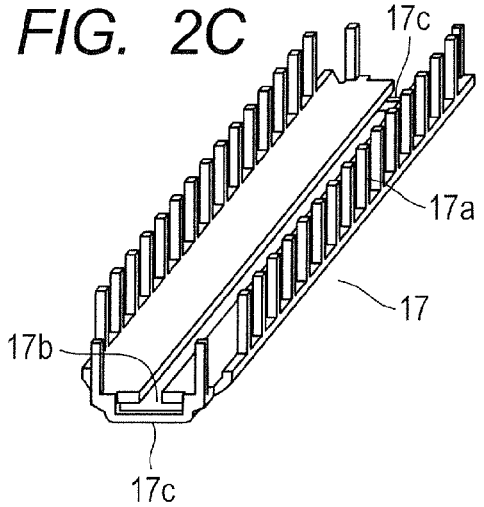

FIG. 2C is a perspective view for illustrating the film guide 17. In the film guide 17, rib arrays 17*a* are formed as lateral wall portions on the upstream side and the downstream side with respect to the nip. The film guide 17 is configured to prevent the fixing film 13 from being brought into direct contact with the stay 16 so as to prevent a temperature drop of the fixing film 13. In addition, the resistance at the time of contact with the fixing film 13 is reduced with the rib arrays 17*a* arranged along the upstream portion and the downstream portion (mainly, the rib array 17*a* along the upstream portion) with respect to the fixing nip so as not to hinder rotation of the fixing film 13. The film guide 17 is arranged as an important heat insulating member. This is particularly because the fixing film 13 is liable to be deprived of heat by the stay 16 having the bottom portion bent so as to increase the contact area of the nip pressure portion, that is, having a high heat capacity, and hence its temperature rise performance may be degraded. Further, similarly to the stay 16, in the film guide 17, a slit portion 17*b* is formed at the nip central portion along a longitudinal direction of the film guide 17 so as to function as a groove portion configured to receive a bottom portion of the heat shielding member 18 and the pressure sliding plate 19. Still further, an upper region of the film guide 17 is opened so as not to hinder the emission of the radiant light of the halogen heater 13*a* onto the inner surface of the fixing film 13. Thus, lower arch portions 17*c* configured to couple members on both sides of the slit portion 17*b* in a transverse direction of the film guide 17 to each other are integrally formed respectively, on both sides of the slit portion 17*b* in the longitudinal direction.

Figure 2D:
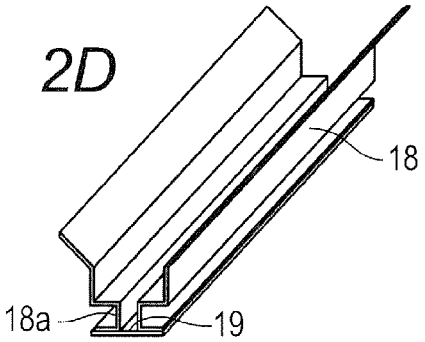

FIG. 2D is a perspective view for illustrating the heat shielding member 18 and the pressure sliding plate 19. The film guide 17 includes the slit portion 17*b* and the lower arch portions 17*c*. With this, a central narrow portion 18*a* of the heat shielding member 18 can be inserted into the film guide 17 in a sliding manner along the longitudinal direction so as to be mounted thereto. Similarly, the pressure sliding plate 19, to be arranged under the central narrow portion 18*a* of the heat shielding member 18, is set to a desired position through the lower arch portions 17*c*.

As illustrated in FIG. 2A, a heating method to be executed by the fixing apparatus 12*c* configured as described above is as follows. First, the radiant light is emitted from the halogen heater 13*a* at a center of an upper unit, and then about an upper half of the inner surface of the fixing film 13 is directly heated by the radiation heat through the upper opening part of the stay 16. Meanwhile, on the upstream side and the downstream side around the nip, the heat shielding member 18 blocks the radiant light so as not to be directly received by the stay 16 and the film guide 17, and hence a temperature rise of the stay 16 and the film guide 17 are suppressed. Simultaneously, the temperature of the heat shielding member 18 itself rises, and the pressure sliding plate 19 is indirectly heated through heat conduction through intermediation of a contact portion between the heat shielding member 18 and the pressure sliding plate 19. A counter-fixing nip side of the pressure sliding plate 19 is directly heated by the radiation heat of the radiant light that enters the central slit, and the temperature of the pressure sliding plate 19 rises along with the heat conduction of the heat shielding member 18. The pressure sliding plate 19, raised in temperature, further heats a region of the fixing film 13, which has already been heated by the radiation heat and passes through the nip portion.

In this way, the fixing film 13 is heated from the inner surface mainly through two upper and lower routes so as to heat and pressurize the recording material passing through the fixing nip portion. With this, the toner image is fixed onto the recording material. The temperature control is performed by a method of controlling the heater through detection of temperature changes on an outer surface of the fixing film 13 with a thermistor 13*d* of an external abutment type, which is arranged above the upper unit so as to be held in press-abutment against the outer surface of the fixing film 13 as illustrated in FIG. 2A.

No significant disadvantages of the performance of this fixing apparatus have been found. Specifically, as listed below, in view of start-up performance and productivity at the time of small size printing, the fixing apparatus has intermediate performance in comparison with those of other types.

(1) The fixing film to be used has a heat capacity lower than those of fixing rollers of fixing apparatus of a heating-roller type, and hence the start-up time period of the fixing apparatus can be reduced. However, it is not easy to shorten the start-up time period to a start-up time period of a film-heating fixing apparatus in which the nip portion is directly heated with a ceramic heater, in the related art.

(2) With regard to temperature rises at edge portions at the time of feeding of small size sheets, the fixing film is lower in heat conductivity and heat capacity in the longitudinal direction than those of the heating-roller type, which are inferior thereto in their performance of reducing temperature differences in the longitudinal direction. However, the temperature rises at the edge portions are more likely to be suppressed than in the film-heating fixing apparatus of the related art, in which only the nip portion is directly heated with the ceramic heater.

However, in order to further increase the heating efficiency and to further suppress the temperature rises at the edge portions, so as to achieve a higher processing speed in the future, it is conceived that some measure other than the utilization of the intermediate superiority of the apparatus needs to be taken. In particular, the fixing film is used, and hence, due to an upper limit of a heatproof temperature of the fixing film at the time of the temperature rises at the edge portions, the productivity at the time of the small size printing may be more severely restricted than in the case of the heating-roller type, in which the same halogen heater is used, in the related art.

Currently, in a group of products of this type, in some of 24 ppm products capable of fixing the toner image at a relatively high speed, there may be employed a configuration for taking measures against the temperature rises at the edge portions, in which two types of halogen heaters different from each other in the distribution of heat to be generated at a central portion and edge portions are driven independently of each other, so as to control the temperature distribution (which is frequently used in the heating-roller type). However, there are the disadvantages that the cost of the heater and a driving circuit thereof are increased, and the performance for full-speed fixing on the small size sheets cannot be achieved.

Figure 3A:
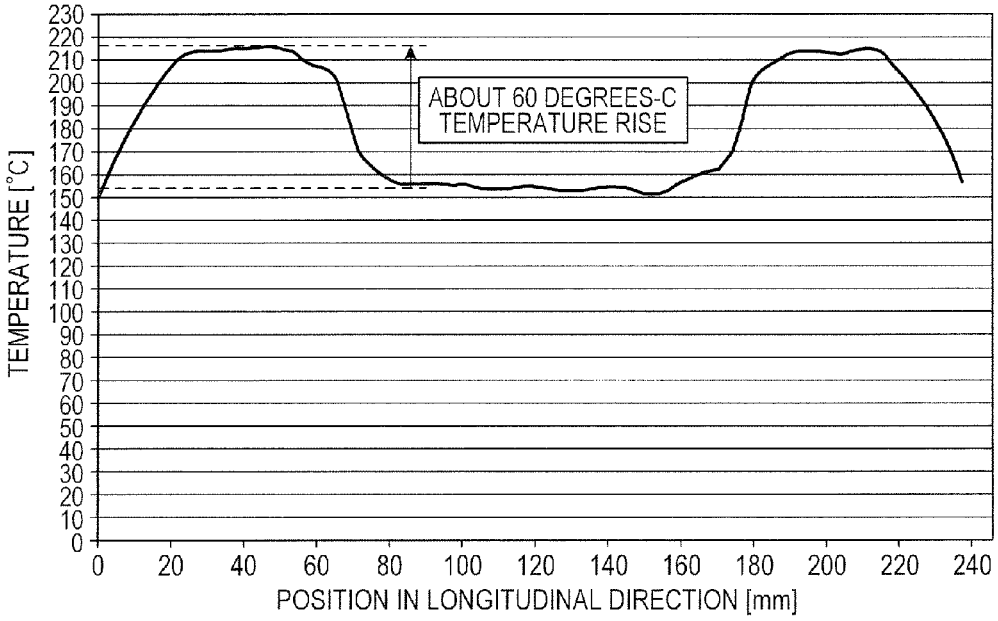
FIG. 3A and FIG. 3B are explanatory graphs for showing the performance of the film heating fixing apparatus of the halogen-heater type as a related art.
Figure 3B:
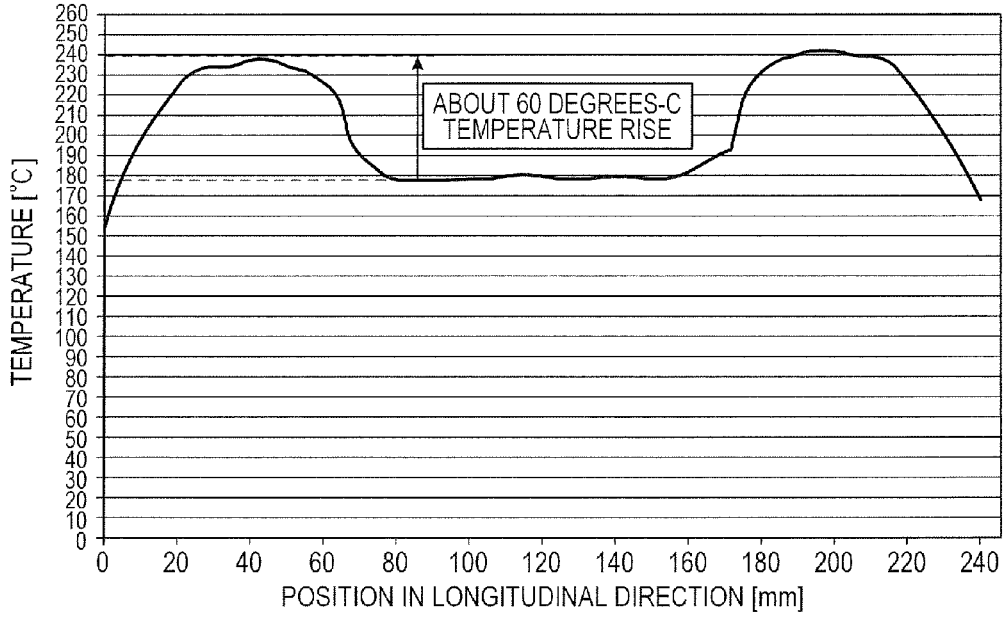

In view of such circumstances, in order to exclusively confirm the superiority of the configuration for taking measures against the temperature rise at the edge portions, an evaluation of characteristics of the temperature rise at the edge portions is carried out through use of a single halogen heater configured to perform heating uniformly in the longitudinal direction. In order that the evaluation is more strictly carried out, COM10 envelopes that are narrow and thick (105 mm×242 mm) are used as the recording materials. Specifically, a test of continuously feeding ten envelopes at intervals of about 0.8 seconds is carried out by using a fixing apparatus of a 24 ppm apparatus capable of fixing the toner image onto twenty four envelopes per minute, and a fixing apparatus of a 40 ppm apparatus capable of fixing the toner image onto forty envelopes per minute. As a result, the results as shown in FIG. 3A and FIG. 3B are obtained. FIG. 3A and FIG. 3B are explanatory graphs for showing the performance at the time of continuously feeding the COM10 envelopes with the film-heating fixing apparatus of the halogen-heater type, in the related art. FIG. 3A is a graph for showing the characteristics of the temperature rises at the edge portions at the time of feeding small size sheets with the medium-speed apparatus, and FIG. 3B is a graph for showing the characteristics of the temperature rises at the edge portions at the time of feeding the small size sheets with the high-speed apparatus. Each of the graphs shows that a temperature difference as high as about 60 degrees-C occurs between the central portion and the edge portions. The graph of FIG. 3A shows that there is substantially no margin with respect to the upper limit temperature of 220 degrees-C of the fixing film having the tightest heat resistance among components in the 24 ppm apparatus. Meanwhile, the graph of FIG. 3B shows that, in the 40 ppm apparatus, the heatproof temperature is significantly exceeded, and hence it is significantly difficult to achieve a higher throughput at the time of printing the small size sheets and the higher processing speed in the future without sacrificing cost efficiency and performance. The results of the evaluation show that the other measures against those problems need to be taken in accordance with the features of this configuration.

Figure 4A:
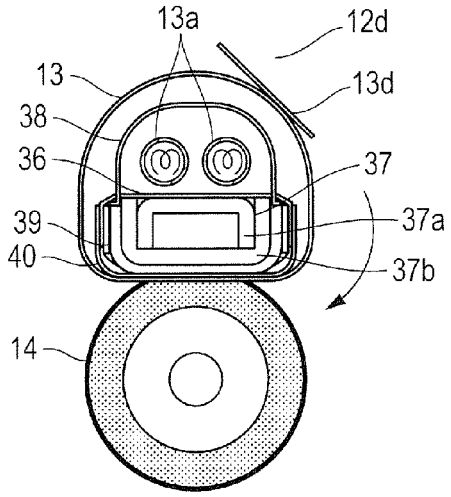
FIG. 4A, FIG. 4B, FIG. 4C and FIG. 4D are explanatory views for illustrating a film heating fixing apparatus of the halogen-heater type as a configuration of other related art.
Figure 4B:
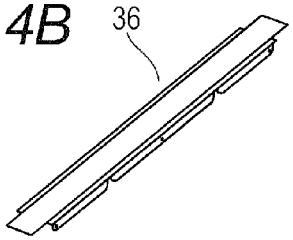
Figure 4C:
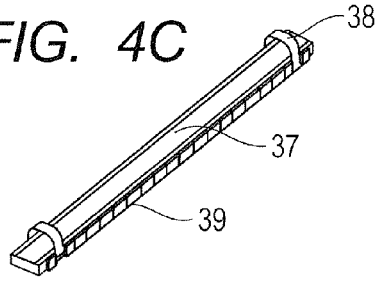
Figure 4D:
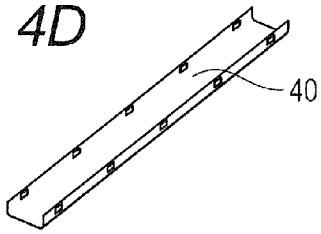

Meanwhile, as a derivation configuration of this fixing apparatus, there has also been put into the market a fixing apparatus 12*d* that does not include, as illustrated in FIG. 4A to FIG. 4D, the introduction portion for passing the radiant light onto the fixing nip portion, and further includes a reflecting plate 36 instead of the heat shielding member 18. In this configuration, the reflecting plate 36 is arranged so as to cause the radiant light of the halogen heaters 13*a* to be emitted only onto the inner surface of the fixing film 13 at the time of passing through an upper half region of the fixing unit, to thereby heat the inner surface. On the fixing nip portion side, only a pressing force is applied. In this way, the toner image is fixed. Further, the stay 16 of FIGS. 2A and 2B is replaced with a plate-like hollow pressure stay 37 formed through a combination of two U-shaped metal plates 37*a* and 37*b* in FIGS. 4A and 4C. Still further, the arch portions 16*a* at the end portions in the longitudinal direction in FIG. 2B are replaced with separate arch metal plates 38, and only a heat insulating member 39 without the film guide 17 is combined as illustrated in FIG. 4C. The plate-like pressure stay 37 is received on an inner side of a large pressure sliding plate 40 illustrated in FIG. 4D, which has edge portions extended to the upstream side and the downstream side with respect to the fixing nip and bent in a manner of wrapping the plate-like pressure stay 37.

In this configuration, as illustrated in the perspective view of FIG. 4B, the reflecting plate 36 has a length sufficient to cover a heating region of the halogen heaters 13*a* in the longitudinal direction. With this, the radiant light emitted downward to the fixing nip side is substantially perfectly blocked. Thus, depending on the reflectance of the reflecting plate 36, the inner surface of the fixing film 13 may be more efficiently heated at the time of passing through the upper half region of the upper fixing unit, to thereby heat the fixing film 13 within a short time period. However, the temperature at the time of fixing is difficult to stabilize. This is because a unit configured to directly heat the fixing nip side is not arranged, and also because, even when the heat insulating member 39 is interposed, the temperature of the fixing film 13 heated in the upper half region is liable to vary as a result of the deprivation of thermal energy by the plate-like pressure stay 37 having a high heat capacity, the heat insulating member 39, the recording material, and the pressure roller 14 at the fixing nip portion and the upstream portion and the downstream portion thereof. In this derivation configuration, a heating unit for the fixing nip portion is not arranged. Thus, in the small size sheet fixing mode, the temperature variation in the longitudinal direction is unlikely to occur at the nip portion. Instead, there are such risks in that "performance of fixing cannot be evenly exerted at the leading edge and a trailing edge of the recording material" and that "the performance of the fixing on subsequent pages at the time of continuous printing is liable to be gradually degraded."

However, in actually available products, as illustrated in the sectional view of FIG. 4A, the two heaters 13*a* that are different from each other in heat distribution are arranged so as to control heating regions in accordance with the width of the recording materials. Also in this configuration, there is the unignorable fact that, when the fixing nip portion is deprived of thermal energy accumulated in the fixing film 13, an uneven temperature distribution may occur, depending on the sheet size. Also from this viewpoint, the two heaters 13*a* are needed to control the temperature distribution.

Further, in the fixing apparatus configured to heat the inner surface of the fixing film with the radiation heat, in addition to the problem of the edge portion temperature rises in the small size sheet fixing mode, there is another problem with the configuration itself of the fixing apparatus, which is configured to heat the inner surface of the fixing film on the counter-fixing nip side with the radiation heat. Specifically, in the fixing apparatus configured as described above, in order to allow the radiant light to be emitted onto the inner surface of the fixing film 13 on the counter-fixing nip side, a member being a shielding object cannot be arranged between upper portions of the heaters and the inner surface of the fixing film 13. Thus, when the fixing film 13 is deformed for some reason, the inner surface of the fixing film 13 and the halogen heaters 13*a* may come into contact with each other. As a result, various kinds of trouble may occur.

Figure 5A:
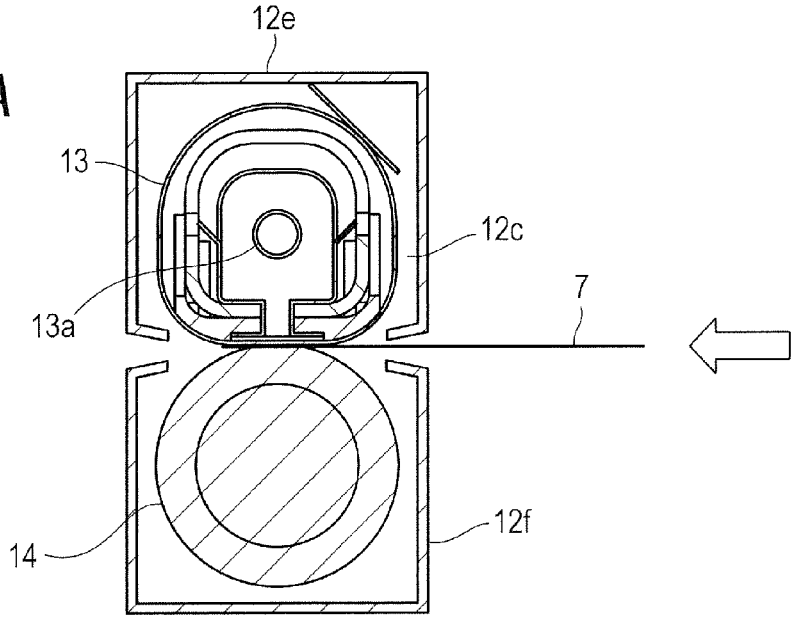
FIG. 5A and FIG. 5B are explanatory views for illustrating a problem with the film-heating fixing apparatus of the halogen-heater type as the configuration of other related art.
Figure 5B:
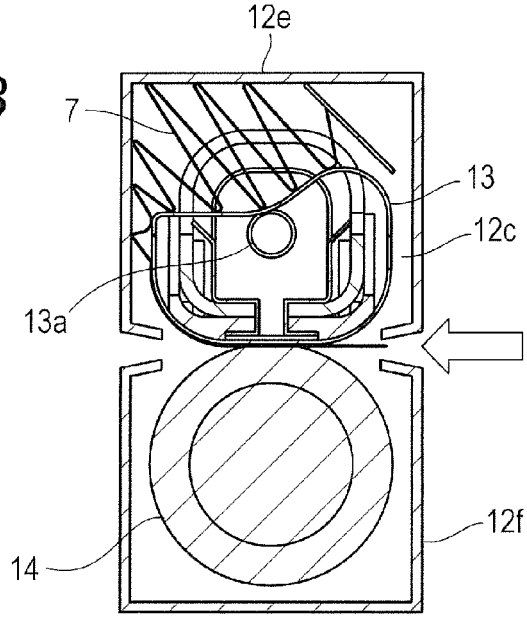

FIG. 5A and FIG. 5B are schematic sectional views for illustrating the problem with the configuration of the related art. Note that, in FIG. 5A and FIG. 5B, an upper fixing unit cover frame 12*e* surrounding the fixing apparatus 12*c*, which is configured to protect the inside of the fixing apparatus 12*c*, and a pressure roller cover frame 12*f* configured to protect the pressure roller 14, are also illustrated. FIG. 5A is an illustration of a state in which the recording material 7 has entered the fixing nip portion from the right side in the drawing sheet. At this time, when conditions to cause the fixing film 13 and the leading edge portion of the recording material 7 to be more forcefully pressed against each other are met, specifically, when the toner images have been formed without a margin at the leading edge portion of the recording material 7, the recording material 7 may be conveyed while rolling around the fixing film 13. FIG. 5B is an illustration of a state in which what is called an accordion jam has occurred. In the fixing unit, the leading edge of the recording material 7 that has rolled around the fixing film 13 may be caught in obstacles, such as the thermistor, and creased into a zigzag shape. The recording material 7 deformed in this way may press down the fixing film 13 to cause the fixing film 13 to be deformed as illustrated in FIG. 5B. As a result, the deformed fixing film 13 may come into contact with the halogen heater 13*a*.

(Fixing Apparatus According to Embodiments of Present Invention)

Figure 6A:
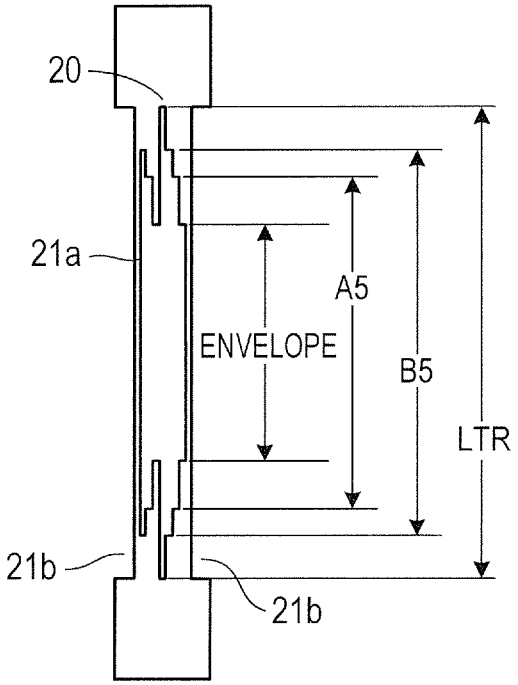
FIG. 6A, FIG. 6B, FIG. 6C and FIG. 6D are explanatory views for illustrating a fixing apparatus according to a first embodiment of the present invention as a configuration of related art.
Figure 6B:
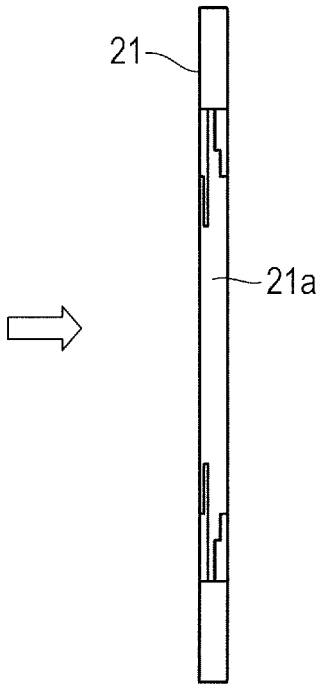

With reference to FIG. 6A to FIG. 11B, the fixing apparatus according to the first embodiment of the present invention is described. FIG. 6A to FIG. 6D are schematic views for illustrating a configuration of a rotary shutter with stepped cutout parts, which is mounted to the fixing apparatus according to the first embodiment of the present invention. FIG. 6A is a developed view for illustrating the rotary shutter, and FIG. 6B is a top view for illustrating a cylindrical form of the configuration of the rotary shutter illustrated in FIG. 6A. FIG. 6C and FIG. 6D are schematic sectional views for illustrating the fixing apparatus according to this embodiment when viewed in a direction orthogonal to a conveying direction of the recording material (the rotation axis direction of the pressure roller 14).

The fixing apparatus 12 according to this embodiment mainly includes the fixing unit including the fixing film 13, the halogen heater 13*a*, the metal pressure stay 16, the film guide 17, the heat shielding member (heat shielding plate) 18, and the pressure sliding plate 19, and a pressure unit including the pressure roller 14. The pressure roller 14 serving as a rotary member and the pressure sliding plate 19 serving as a support member are held in press-contact with each other through the intermediation of the fixing film 13. With this, the fixing nip portion for nipping and conveying the recording materials is formed. The halogen heater 13*a* serving as a heating member is arranged so as to face the inner peripheral surface of the flexible cylindrical fixing film 13 at a position kept out of contact therewith. With this, the radiant light is emitted onto the inner peripheral surface of the fixing film 13 to raise the temperature of the fixing film 13. The heat shielding plate 18 serving as a first shielding member is fixed at a position between the fixing film 13 and the halogen heater 13*a* to form a region of blocking the radiation heat (first shielding region) all over the width direction orthogonal to a circumferential direction of the film (conveying direction of the recording materials) in a predetermined range in the circumferential direction. A rotary shutter 21 serving as a second shielding member is arranged so as to surround the halogen heater 13*a*, and the radiant light emitted from the halogen heater 13*a* is emitted restrictively onto the inner surface of the fixing film 13 through opening portions formed through the rotary shutter 21 (described in detail later). The metal pressure stay 16, the film guide 17, the heat shielding plate 18, and the pressure sliding plate 19 have the same configurations as those in the related art, and hence are not described.

The rotary shutter 21 is a cylindrical member formed of an aluminum plate (or stainless plate) having a thickness of 0.5 mm, which is the same as that for the heat shielding plate 18, and has a first opening portion 21*a* formed through a part of a peripheral wall. The rotary shutter 21 is arranged so as to be rotationally movable in a region between the fixing film 13 and the halogen heater 13*a*, and the first opening portion 21*a* thereof forms another shielding region (second shielding region) than the heat shielding plate 18. In other words, out of the shielding region of the heat shielding plate 18, the rotary shutter 21 is capable of forming regions blocking the radiation heat on the inner peripheral surface of the fixing film 13, specifically, in a predetermined range in the circumferential direction of the film and on an inner side between edge portions in a width direction of the film. The sizes in the film width direction (the recording material width direction) of the radiation heat shielding regions formed by the rotary shutter 21 are set so that the size in the film width direction of a radiation heat emitting region formed of the first opening portion 21*a* corresponds to widths of the recording materials. With this, the radiation heat to be emitted onto the inner peripheral surface of the fixing film 13 can be blocked so that, in the film width direction, the emitting amount in regions at edge portions of the inner peripheral surface is smaller than the emitting amount in a region (central region) on an inner side with respect to the regions at the edge portions.

A width of the first opening portion 21*a* in an axial direction thereof (direction orthogonal to the conveying direction of the recording materials, or width direction of the film) is set so as to vary in a circumferential direction thereof (conveying direction of the recording materials, or circumferential direction of the film) in accordance with various sizes of the recording materials. The width of the first opening portion 21*a* varies in accordance with four widths of the recording materials to be subjected to fixing, specifically, a letter (LTR) size width, which is the largest, a B5 size width, an A5 size width, and a COM10 envelope size width. The first opening portion 21*a* is formed into such a shape that central positions of the widths match with each other in the axial direction, that is, the width of the first opening portion 21*a* varies in a stepped pattern (stepwise manner) symmetrically in the width direction with respect to a center in the width direction of the recording materials. Further, the widthwise regions vary from each other along the circumferential direction so that the center of a widthwise region of the letter (LTR) size corresponds to the center in the circumferential direction of the opening portion 21*a*. A metal plate 20 (FIG. 6A) having the first opening portion 21*a*, which is configured as described above, is rolled into a cylindrical shape. With this, the rotary shutter 21 (FIG. 6B) configured to be capable of changing the sizes in the width direction of the radiation heat shielding regions in accordance with the size of the widths of the recording materials is formed.

Figure 6C:
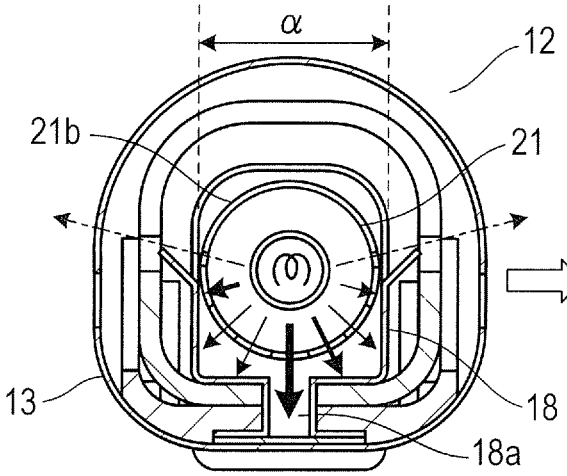
Figure 6D:
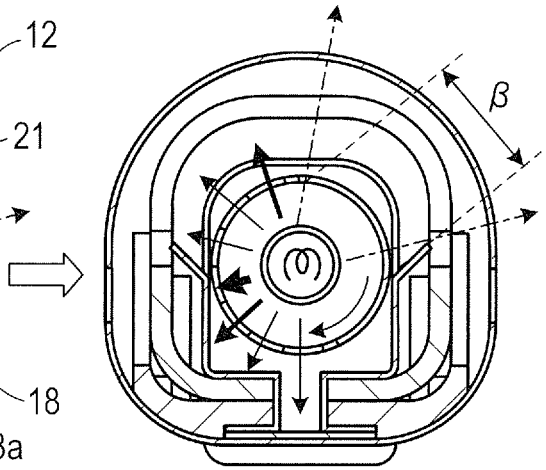

The rotary shutter 21 described above is inserted in a sliding manner from a lateral surface side of the fixing apparatus (the near side or the far side of the drawing sheets of FIG. 6C and FIG. 6D) so as to be arranged around the halogen heater 13*a* concentrically with a center of the heater. When the rotary shutter 21 is installed on an inner side with respect to the heat shielding plate 18 in this way, a novel configuration for taking measures against the temperature rises at the edge portions according to the present invention is obtained. FIG. 6C is an illustration of a widest recording material fixing mode of this configuration for taking measures against the temperature rises at the edge portions, and FIG. 6D is an illustration of a narrowest recording material fixing mode thereof. As is apparent from the developed view (FIG. 6A), except for the central region in a longitudinal direction of the rotary shutter 21, in which the first opening portion 21*a* is formed, both edge portions in the longitudinal direction of the rotary shutter 21 are each formed into a substantially perfectly cylindrical shape, and end surfaces in the longitudinal direction are each opened into a circular shape.

The rotary shutter 21 is arranged so as to surround the halogen heater 13*a*, and is supported so as to be rotatable about the halogen heater 13*a*. The rotary shutter 21 is rotated from a position (first position) at which the first opening portion 21*a* overlaps with the shielding region of the heat shielding plate 18 to a position (second position) at which the first opening portion 21*a* is out of this shielding region. In this state, the radiation heat to be emitted onto the regions at the edge portions of the inner peripheral surface of the fixing film 13 is blocked. When a position (phase) of the first opening portion 21*a* with respect to the halogen heater 13*a* is changed along with rotation of the rotary shutter 21, the range in which the radiant light of the halogen heater 13*a* is emitted onto regions on an outside of the rotary shutter 21 varies. The position (phase) of the rotary shutter 21 is controlled by a driving source unit and a rotation amount control unit (not shown) so that, at the time of a fixing step, the rotary shutter 21 is stopped at a predetermined position (phase) in accordance with the width of the recording materials to be subjected to fixing.

In the widest recording material fixing mode illustrated in FIG. 6C, the rotary shutter 21 is set in such an arrangement that a region corresponding to the LTR width in the first opening portion 21*a* comes to a lowermost position, to thereby allow the radiant light corresponding to the LTR width to enter the central narrow portion 18*a* at a back of the fixing nip. With this, the radiant light from the halogen heater 13*a* enters, with the LTR width, the back of the fixing nip, to thereby raise the temperature of a back surface of the pressure sliding plate 19 (region at the back of the fixing nip portion).

Meanwhile, the rotary shutter 21 has a second opening portion 21*b* that is widely opened with a width substantially equal to the LTR width in a region facing the inner surface of the fixing film 13 on the counter-fixing nip side. In the second opening portion 21*b* on the counter-fixing nip side, right and left edges of the opened region with a width $\alpha$ that is equal to the shutter diameter are lower in height than right and left upper edges of the heat shielding plate 18. Thus, in an upper part of the region sectioned by the dashed-line arrows on the right and left in FIG. 6C, the radiant light of the halogen heater 13*a* can be emitted onto the inner surface of the fixing film 13 by an amount substantially equal to those in the configurations of the related art. Note that, in this state, in the first opening portion 21*a*, the radiant light is emitted through regions corresponding to the widths other than the LTR width by amounts corresponding to the respective widths. A magnitude relationship between the emitting amounts is schematically represented by the thicknesses of the radial arrows in FIG. 6C.

In the narrowest recording material fixing mode illustrated in FIG. 6D, the rotary shutter 21 is set in such an arrangement that a region corresponding to the COM10 envelope width in the first opening portion 21*a* comes to the lowermost position, to thereby allow the radiant light corresponding to the smallest COM10 envelope width to enter the central narrow portion 18*a*. In order to enter the state of FIG. 6D, the rotary shutter 21 in the state of FIG. 6C is rotated clockwise with the driving source unit and the rotation amount control unit (not shown), as indicated by the circular-arc arrow in FIG. 6D, and then is stopped. With this, the radiant light from the halogen heater 13*a* enters, with the COM10 envelope width, the back of the fixing nip, to thereby raise the temperature of the back surface of the pressure sliding plate 19.

Meanwhile, in the region on the counter-fixing nip side, the regions corresponding to the B5 width, the A5 width, and the COM10 envelope width in the first opening portion 21*a* enter an exposure range with respect to the inner surface of the fixing film 13. In this state, the rotary shutter 21 faces the inner surface of the fixing film 13. Further, along with the rotation of the rotary shutter 21, the second opening portion 21*b* on the counter-fixing nip side under a state of entirely overlapping with the exposure range with respect to the inner surface of the fixing film 13 as illustrated in FIG. 6C is changed into a state of partially overlapping with the exposure range with respect to the inner surface of the fixing film 13. With this situation, as illustrated in FIG. 6D, an exposable region of the second opening portion 21*b* on the counter-fixing nip side is downsized to the width β with respect to the upper right edge of the heat shielding plate 18. As a result, exposure rates in the regions at the edge portions of the inner surface of the fixing film 13 are reduced overall.

FIG. 7A to FIG. 7C and FIG. 8A to FIG. 8C are schematic views for illustrating only the members that are necessary for a description of the operation described above.

Figure 7A:
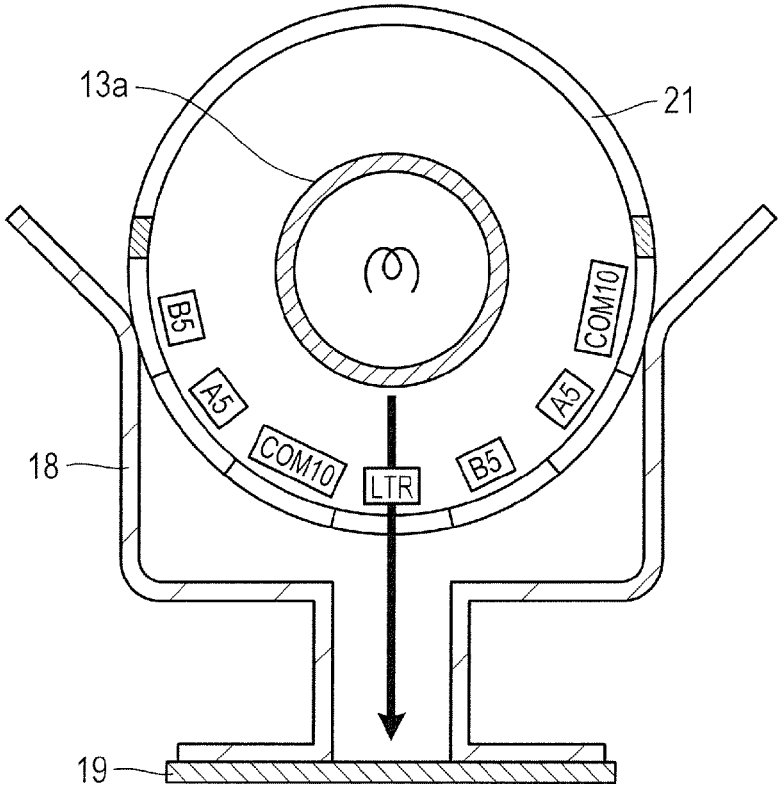
FIG. 7A, FIG. 7B and FIG. 7C are explanatory views for illustrating a configuration of a rotary shutter according to the first embodiment of the present invention.
Figure 7B:
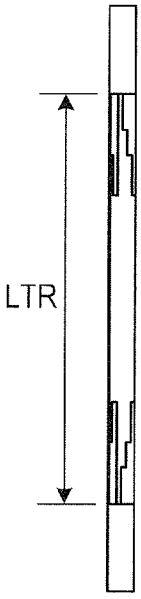
Figure 7C:
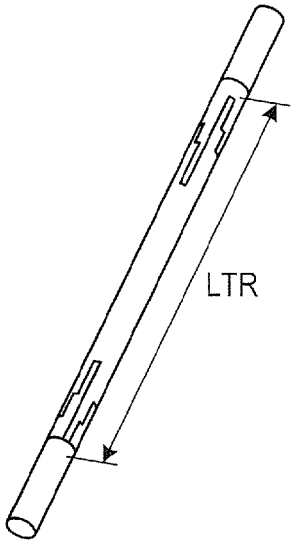

FIG. 7A is a schematic sectional view for illustrating the heat shielding member 18, the pressure sliding plate 19, and the rotary shutter 21 under the state in which the rotary shutter 21 is at the position (phase) in a case where the LTR size sheet is selected as illustrated in FIG. 6C. FIG. 7B is a top view for illustrating the rotary shutter 21 under the state of FIG. 7A, and FIG. 7C is a perspective view for illustrating the rotary shutter 21 under the state of FIG. 7A. As illustrated in FIG. 7A, in the LTR size sheet fixing mode, the rotation of the rotary shutter 21 is stopped in a phase where the LTR size cutout part comes to a position facing the fixing nip (lowermost end). As illustrated in FIG. 7B and FIG. 7C, in the rotary shutter 21, the opening portion having the length corresponding to the LTR width is arranged on a lower surface side facing the fixing nip. In FIG. 7A, the positions of the cutout parts corresponding to the other sheet sizes in this state are represented by the imaginary labels that are arranged so as to respectively indicate the names of the sheet sizes corresponding to the cutout parts. As illustrated in FIG. 7A, in this embodiment, the cutout parts corresponding to the sheet sizes other than the LTR size are doubly arranged in the same order on each side in the circumferential direction with respect to the one LTR size cutout part as a center. Specifically, the cutout parts are arranged counterclockwise from the left to the right in the drawing sheet in such an order that the corresponding sheet widths are gradually reduced.

Figure 8A:
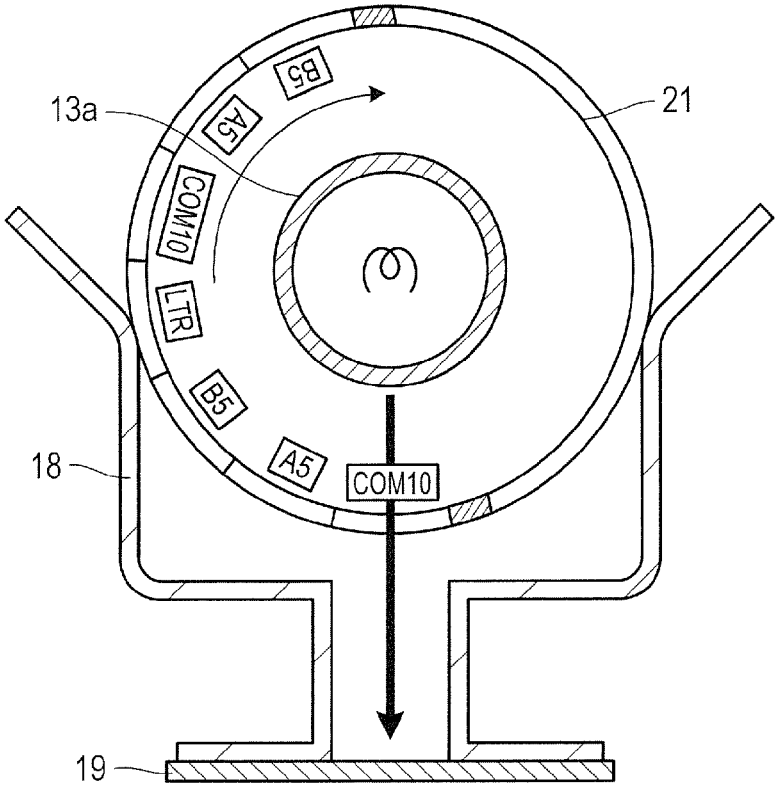
FIG. 8A, FIG. 8B and FIG. 8C are explanatory views for illustrating the configuration of the rotary shutter according to the first embodiment of the present invention.
Figure 8B:
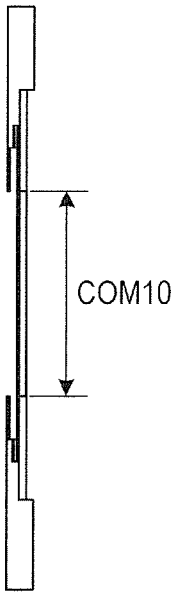
Figure 8C:
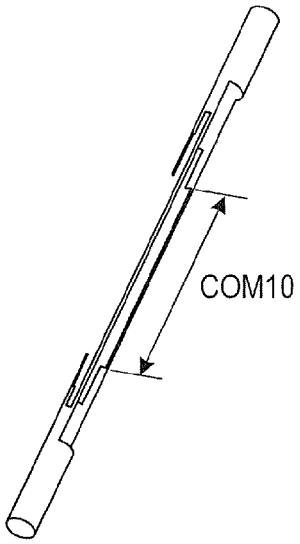

FIG. 8A is a schematic sectional view for illustrating the heat shielding member 18, the pressure sliding plate 19, and the rotary shutter 21 under the state in which the rotary shutter 21 is at the position (phase) in a case where the COM10 size sheet is selected as illustrated in FIG. 6D. FIG. 8B is a top view for illustrating the rotary shutter 21 under the state of FIG. 8A, and FIG. 8C is a perspective view for illustrating the rotary shutter 21 under the state of FIG. 8A. As illustrated in FIG. 8A, in the COM10 size sheet fixing mode, the rotation of the rotary shutter 21 is stopped in the phase where the COM10 size cutout part comes to a position facing the fixing nip (lowermost end). As illustrated in FIG. 8B and FIG. 8C, in the rotary shutter 21, the opening portion having the length corresponding to the COM10 width is arranged on the lower surface side facing the fixing nip. In FIG. 8A, positions of the cutout parts corresponding to the other sheet sizes in this state are represented by the imaginary labels that are arranged so as to respectively indicate the names of the sheet sizes corresponding to the cutout parts.

Under the state illustrated in FIG. 8A to FIG. 8C, the opening portion having the length corresponding to the COM10 width faces the central portion in the longitudinal direction of the fixing nip, and the radiant light projected in a direction toward both edge portions in the longitudinal direction is reflected by an inner surface of the rotary shutter 21, which surrounds the opening portion. In this way, the heating width is limited to the COM10 envelope size. Meanwhile, in the region on the counter-fixing nip side in FIG. 8A (upper region in FIG. 8A), specifically, in the upper left portion in FIG. 8A, a part of the rotary shutter 21, which includes the cutout parts corresponding to the B5, the A5, and the COM10 envelope sizes, protrudes upward with respect to the upper edges of the heat shielding plate 18. Thus, the radiant light from the halogen heater 13*a* projected in a direction toward the regions at the edge portions of the inner surface of the fixing film 13 is partially blocked, and hence heating of the edge portions of the fixing film 13 is also partially restricted on the counter-fixing nip side. Therefore, in this case, on each of the fixing nip side and the counter-fixing nip side on the inner surface of the fixing film 13, heating of regions at the edge portions on an outside of the COM10 envelope width (non-sheet feeding-edge portions) is suppressed. As a result, the temperature rises at the edge portions in the case of fixing the toner image onto the COM10 envelopes can be significantly suppressed.

Figure 9A:
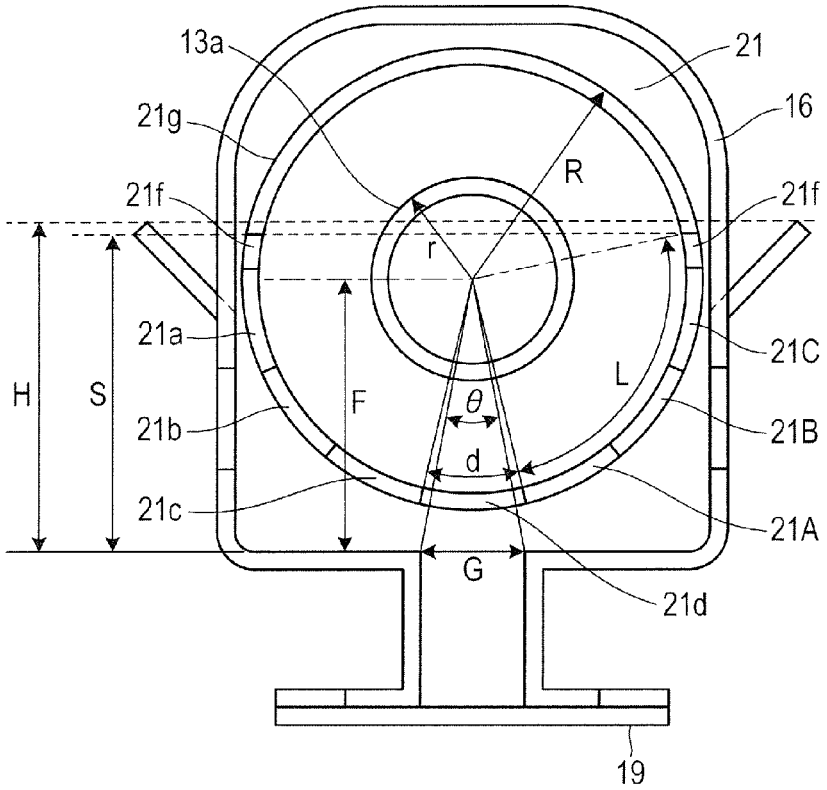
FIG. 9A is an explanatory view for illustrating the configuration of the rotary shutter according to the first embodiment of the present invention.

FIG. 9A is a schematic sectional view for illustrating a magnitude relationship in dimensions and a positional relationship between the members for allowing the function of the cutout rotary shutter 21 described above to be exerted. Those various dimensions illustrated in FIG. 9A are as follows.

G: Width of the slit of the heat shielding plate 18 (width in the conveying direction of the recording materials).

θ: Angle to be formed between the line segments connecting the center of the halogen heater 13*a* and both the opening edges in the slit width G direction of the slit portion of the heat shielding plate 18 in the cross-section of FIG. 9A.

d: Opening width of a cutout part that allows the radiant light to be emitted over a region having a width equal to or larger than the slit width G (circular-arc length).

F: Shortest distance between the center of the halogen heater 13*a* and the slit forming surface of the heat shielding plate 18.

H: Shielding height of the central opening region of the heat shielding plate 18, which is measured from the slit forming surface.

R: Outer radius of the rotary shutter 21.

r: Outer radius of the halogen heater 13*a*.

L: Circular-arc length from both edge portions in the circumferential direction of the widest cutout part to the upper edge portion of the cutout part forming region under a state in which the widest cutout part is arranged at the lowermost position in the widest recording material fixing mode.

S: Height of the upper end surfaces of bridge portions 21*f* formed at both the upper edge portions of the cutout part forming region (frame portions formed through a rounding process on both edges in the transverse direction of the cutout part forming region in FIG. 6A), which is measured from the slit forming surface of the heat shielding plate 18.

On a premise that the relationships of "R>r", "F≥R", and "H>S" are satisfied in the above-mentioned dimensions, the dimensions are adjusted so as to satisfy the following relationship.

$$d=\pi R\ \{\tan^{-1}(G/2F)\}/90.$$

Further, when the cutout part forming region is formed substantially over half of a circumference of the cylindrical rotary shutter 21 (the upper edge portion of the region is allowed to be exposed by ½d with respect to a highest horizontal plane between the upper edges of the heat shielding plate 18), the dimensions are adjusted so as to satisfy the following relationship.

$$N=\{\tan^{-1}(G/2F)\}/180+1,$$

where "N" is the number of switchable patterns of widths of the recording materials.

In this embodiment, in order that the rotary shutter 21 has such a size as to be received in fixing units of the related art, "N" is maintained at 4, and the other values are adjusted.

Figure 9B:
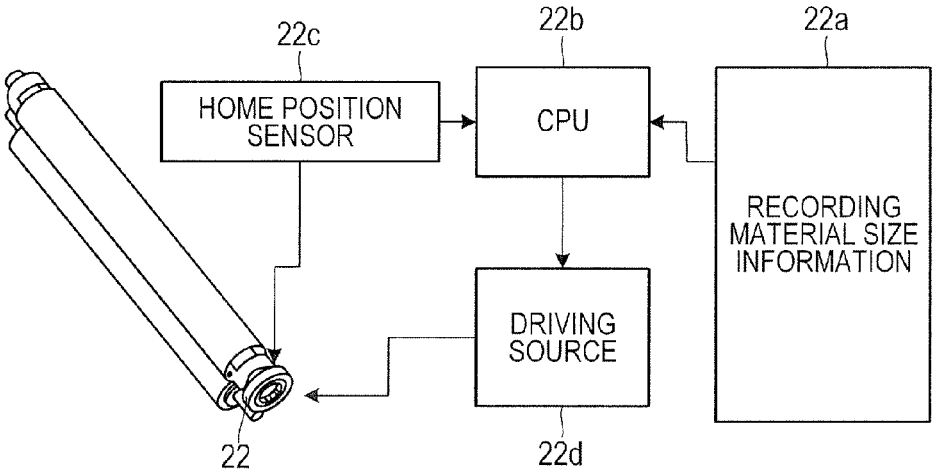
FIG. 9B is a block diagram for illustrating a configuration of a system configured to drive the rotary shutter.

FIG. 9B is a block diagram for illustrating a configuration of a system configured to drive the rotary shutter 21 in the image forming apparatus that uses the fixing apparatus 12 having installed thereto the cutout rotary shutter 21 configured as described above. In FIG. 9B, both edge portions of the rotary shutter 21 are held in a rotatable manner by bearing members (not shown), and a shutter driving gear 22 is arranged at any one of the edge portions. When a power source of the image forming apparatus is turned on, a CPU 22*b* serving as a control unit causes a driving source 22*d*, such as a motor, to be driven, to thereby rotate the rotary shutter 21 through the intermediation of the shutter driving gear 22. At the same time, the CPU 22*b* causes a home position sensor 22*c*, such as a photo interrupter, (not shown) to be driven so as to detect a shutter reference position, which is preset for an edge portion of the shutter, and causes the rotary shutter 21 to be stopped at the reference position. In this way, the rotary shutter 21 is maintained in this standby mode. Next, a user of the apparatus inputs size information of a recording material to the CPU 22*b* via, for example, a host computer, an operation panel of a body of the apparatus, and a recording material size-detection unit configured to reflect settings of size regulating plates of a recording material cassette. Then, the CPU 22*b* controls the driving source 22*d* to rotate the rotary shutter 21, and to stop the rotary shutter 21 at a time when a cutout part corresponding to the input recording material width reaches the slit portion at the back of the fixing nip.

Figure 10A:
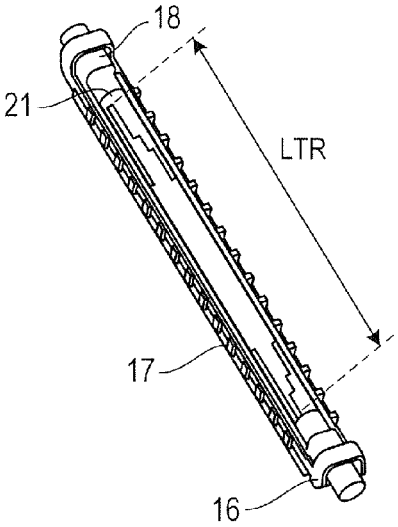
FIG. 10A and FIG. 10B are explanatory views for illustrating the configuration of the rotary shutter according to the first embodiment of the present invention.
Figure 10B:
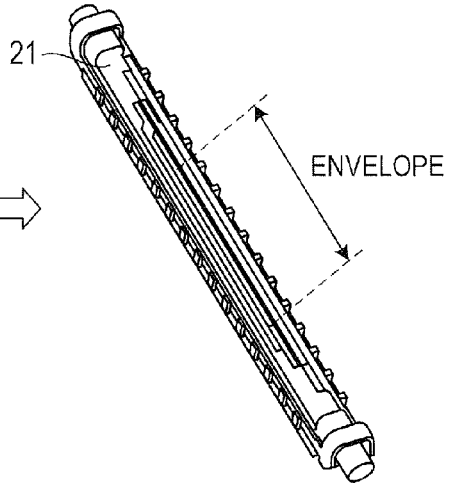

FIG. 10A and FIG. 10B are perspective views for illustrating a configuration in which the fixing film 13 is removed from the upper fixing unit including the rotary shutter 21 when a setting is changed from the LTR size fixing mode (FIG. 10A) to the COM10 envelope size fixing mode (FIG. 10B) by the above-mentioned driving system. In FIG. 10A and FIG. 10B, arrangements in the upper fixing unit in the respective modes are illustrated. As understood from the perspective view of FIG. 10B for illustrating a state after the change, the COM10 envelope size cutout part of the rotary shutter 21 is arranged in a portion facing the slit portion at the back of the fixing nip so that, in the fixing nip portion, the exposure width in the longitudinal direction is limited to the COM10 envelope size. Meanwhile, in an opening region in the upper half portion of the fixing unit, not only is another COM10 envelope size cutout part exposed, but also the B5 size cutout part and the A5 size cutout part are exposed in a stepped pattern so that exposure amounts at both the edge portions in the longitudinal direction are reduced overall.

Figure 10C:
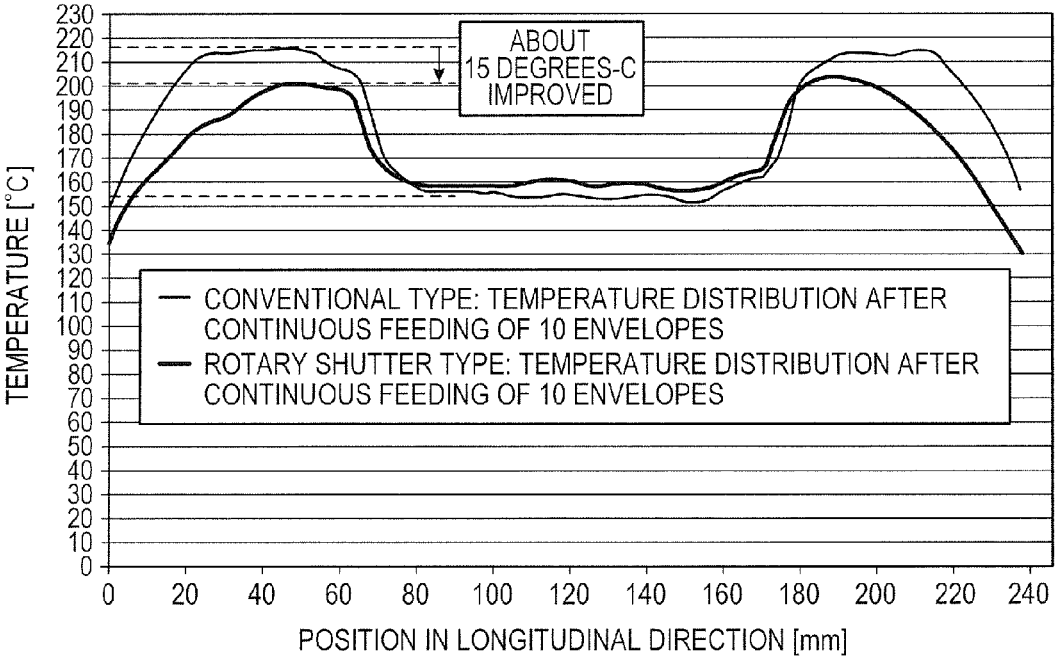
FIG. 10C is an explanatory graph for showing the performance of the rotary shutter of the first embodiment according to the present invention.

FIG. 10C is a graph for showing results of verification of the advantages in a case where the drive of the rotary shutter 21 is controlled as described above to limit the exposure amounts of the radiant light at the edge portions in the longitudinal direction. In other words, FIG. 10C is a graph for showing temperature distributions in the longitudinal direction of the fixing unit in the COM10 envelope continuous feeding mode. In the verification, the above-mentioned setting change is performed in the fixing apparatus of 24 ppm, and levels of temperature rises at the edge portions immediately after continuous feeding of ten COM10 envelopes are measured. The temperature distributions shown in the graph are obtained by measuring temperatures along the longitudinal direction of the fixing unit at a central portion in a height direction of the lateral wall of the fixing unit. The thin line in the graph indicates results of performing, in the LTR size fixing mode, the continuous feeding of ten COM10 envelopes with the smallest size, that is, results of measurement under a condition substantially the same as that in the related art, in which measures for increasing the productivity at the time of the small size printing are not taken.

In the configuration of the related art, with respect to a preset fixing temperature of 150 degrees-C, temperatures at a central sheet feeding portion are maintained at substantially 155 degrees-C on average. Meanwhile, temperatures at both the edge portions rise up to approximately 215 degrees-C as a result of the continuous feeding of the COM10 envelopes. In this way, a difference of substantially 60 degrees-C occurs. The upper limit of the heatproof temperature of the fixing film is substantially 220 degrees-C, and hence there is no temperature margin. Thus, in this state, the speed of the continuous feeding needs to be limited.

Meanwhile, when the rotary shutter 21 of this embodiment is set so that the emitting region is limited by the COM10 envelope size cutout part, in the fixing nip portion and an upper half portion on the counter-fixing nip side, exposure rates at edge portions in the longitudinal direction are reduced. With this, even when the continuous feeding of the COM10 envelopes is performed in the same way, the results as indicated by the thick curve in the graph are obtained. In this embodiment, the temperature rises at the edge portions are suppressed by substantially 15 degrees-C, which shows that the restriction on the continuous feeding against the temperature rises at the edge portions can be significantly suppressed. In addition, the results are obtained through the test of the continuous feeding of the COM10 envelopes, that is, the test carried out in expectation of practical advantages to be obtained under the severest condition. Thus, as a matter of course, great advantages can be obtained also in continuous feeding of the recording materials having the other widths.

Figure 11A:
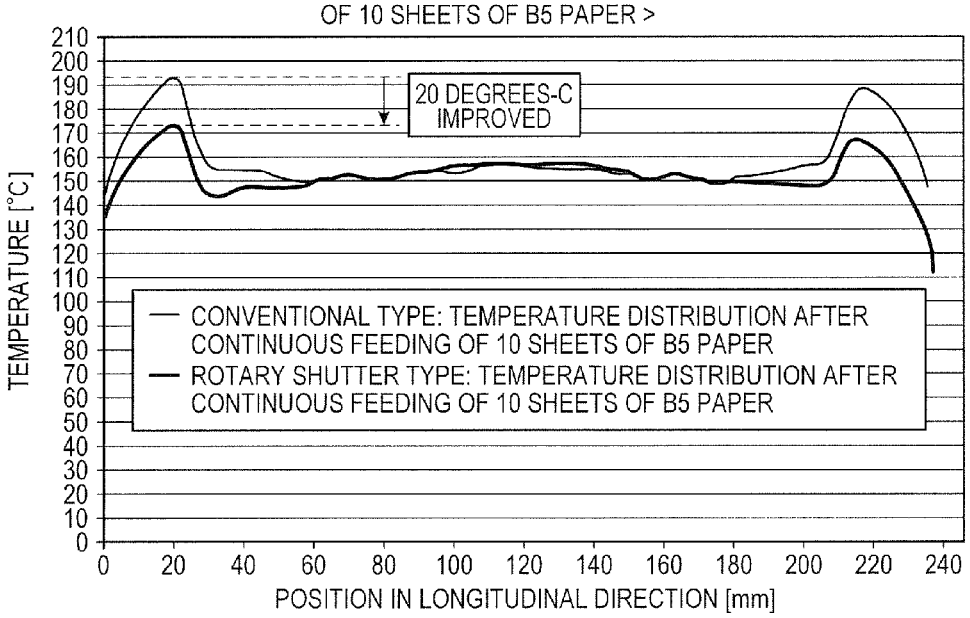
FIG. 11A and FIG. 11B are explanatory graphs for showing the performance of the rotary shutter according to the first embodiment of the present invention.
Figure 11B:
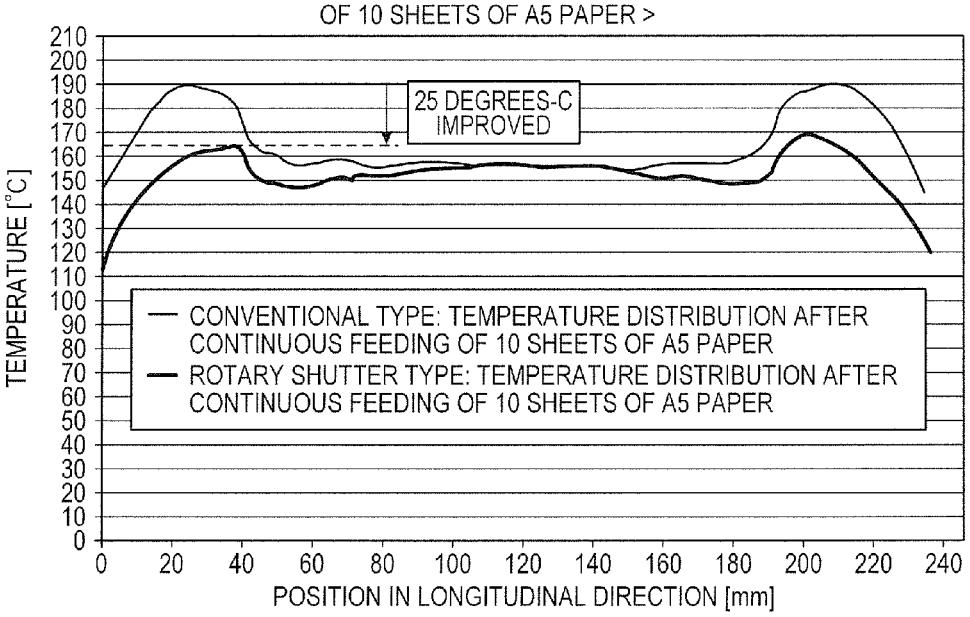

FIG. 11A and FIG. 11B are graphs for showing the results of verification of the advantages in a case where the rotary shutter 21 of this embodiment is used for the other sheet sizes in which the temperature-rise conditions at the edge portions are eased. FIG. 11A is a graph for showing the verification results of the B5 size, and FIG. 11B is a graph for showing the verification results of the A5 size. As shown in FIG. 11A and FIG. 11B, as a result of radiation heating by using the rotary shutter 21 in which the cutout parts corresponding to those recording material widths are set, conspicuous advantages are obtained in each of the sizes. Originally, temperatures at edge portions of the recording materials having those width sizes do not rise extremely in degree or widely in area. Thus, the influence of the heat conduction is suppressed, and hence an effect of light blocking by the rotary shutter 21 is more efficiently exerted. As a result, greater advantages of suppressing temperature rises, that is, higher degrees of temperature drops by 20 degrees-C and 25 degrees-C can be achieved.

Note that, as understood from the verification results described above, although there is a tendency for temperatures drop at the edge portions in the longitudinal direction of the sheet feeding portion in the case where the rotary shutter 21 is used, the temperature drops thereat are caused by restriction in mounting accuracy due to use of test components. As a matter of course, at the time of practical use of appropriate components, the temperature distributions in the sheet feeding portion are further flattened. Further, as understood from the results described above, the values of the suppressed temperature rises are somewhat different from each other. Basically, a rate of the temperature rises at the edge portions tends to become higher as the recording material width is smaller, and hence advantages to be obtained by the measures tend to be reduced. However, the rate of the temperature rises depends not only on the widths, but also on the thicknesses of the recording materials. Thick sheets each having a basis weight of 128 g are used as the B5 size sheets in FIG. 11A, and thin sheets each having a basis weight of 64 g are used as the A5 size sheets in FIG. 11B. Thus, in contrast to the difference in recording material width, the degrees of the temperature rises are inverted. In accordance therewith, opposite tendencies are shown as the advantages to be obtained by the measures.

Figure 12A:
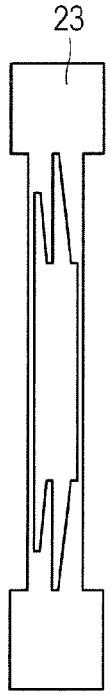
FIG. 12A and FIG. 12B are explanatory views for illustrating modifications of the rotary shutter according to the first embodiment of the present invention.

The rotary shutter 21 described above is formed of metal plate 20 having the stepped cutout portions. However, the various widths of the cutout parts need not necessarily be set in such a stepwise manner. Specifically, as illustrated in FIG. 12A, the various widths may be seamlessly (linearly) set by forming the rotary shutter 21 through a rounding process on a metal plate 23 having linear cutout parts formed therein. With this configuration, a finer adjustment can be performed even when using recording materials having widths other than the widths of the recording materials of the regular sizes.

Figure 12B:
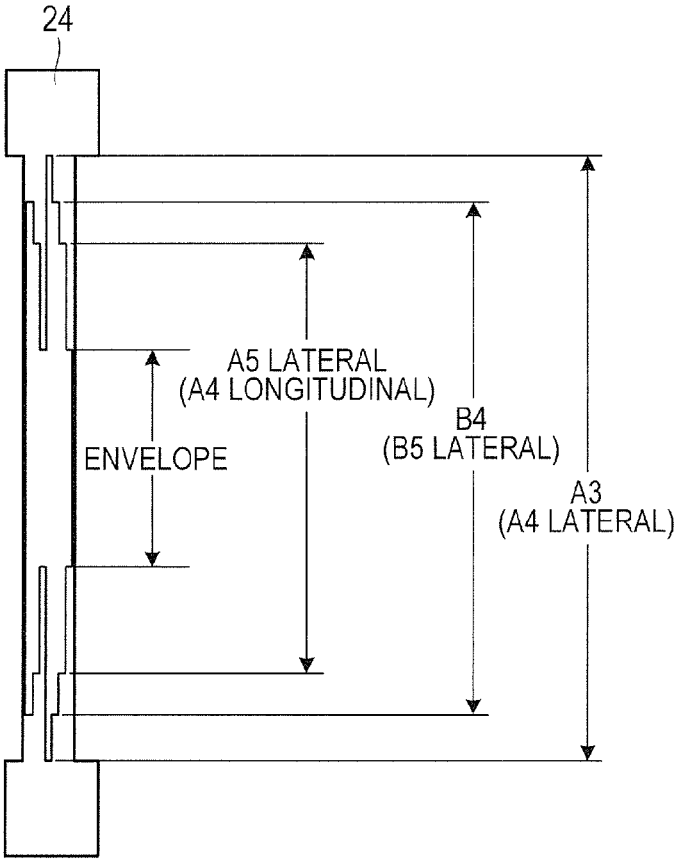

Further, when the present invention is applied not only to the apparatus accepting the recording materials of the A4 size type, but also to apparatus for recording materials of such an A3 size type that temperatures at edge portions are liable to more drastically rise, as illustrated in FIG. 12B, the rotary shutter 21 may be formed of a metal plate 24 that further includes a cutout corresponding to the A3 size type. With this, also in the apparatus of the A3 size type, the great advantages of suppressing the temperature rises at the edge portions can be obtained similarly to those obtained as shown by the results described above. Further, the apparatus can respond to a case of using small size sheets, such as the COM10 envelopes, without reducing the printing speed.

<Second Embodiment>

Figure 13A:
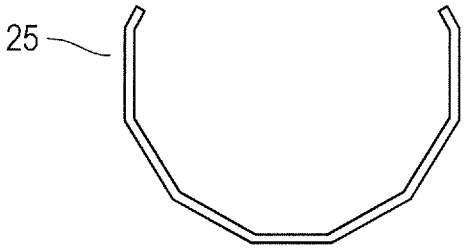
FIG. 13A and FIG. 13B are explanatory views for illustrating a configuration of a rotary shutter according to a second embodiment of the present invention.
Figure 13B:
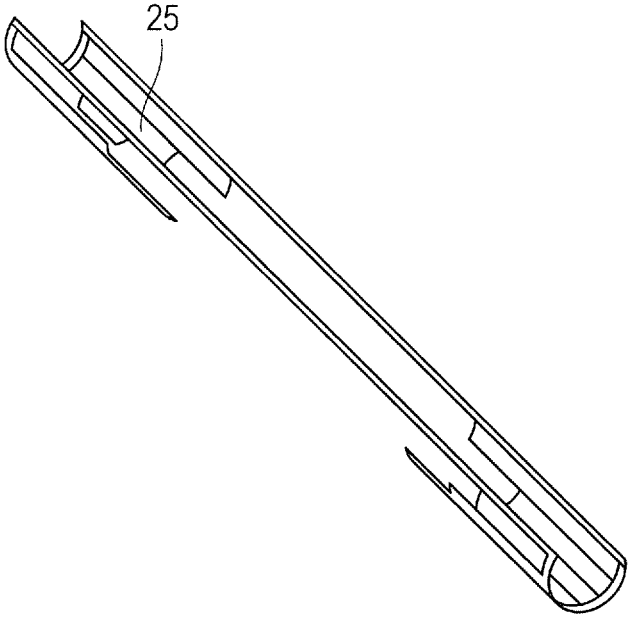

FIG. 13A and FIG. 13B are schematic views for illustrating a configuration of a rotary shutter 25 to be used in a fixing apparatus according to a second embodiment of the present invention. FIG. 13A is a sectional view, and FIG. 13B is a perspective view. Features other than the rotary shutter 25 are the same as those in the first embodiment, and hence are not described.

The rotary shutter 21 of the first embodiment is processed into a circular cylindrical shape in its cross section. Meanwhile, as illustrated in FIG. 13A, the rotary shutter 25 of this embodiment is formed of a plurality of flat portions that are continuously formed while being gradually varied in angle so as to be formed into a substantially circular-arc shape or a substantially half-cylindrical shape as a whole. Specifically, a process of bending at an angle of 27° is repetitively and sequentially executed from a reference surface at any one of the edge portions of each cutout part. With this, the rotary shutter can be obtained without execution of the rounding process that is relatively difficult. In addition, the same functions and advantages as those of the rotary shutters formed through the rounding process can be obtained.

When the rotary shutter 25 including the flat bent portions as illustrated in the perspective view of FIG. 13B is used, there are advantages over the rotary shutter 21 of the first embodiment in terms of workability in the rounding process and accuracy in positioning in accordance with variation in shape after the rounding process. Further, the rotary shutter 21 of the first embodiment has risks in that, due to a curvature of the edge portions of the cutouts, a gap between the rotary shutter 21 and the slit opening portion at the back of the fixing nip is liable to be expanded, and leakage of the radiant light is liable to increase. The rotary shutter 25 of this embodiment is capable of overcoming such risks, specifically, exerting advantages as follows:

increases in workability and working accuracy; and improvement in heating efficiency through suppression of the leakage of the radiant light at the back of the fixing nip.

<Third Embodiment>

Figure 14A:
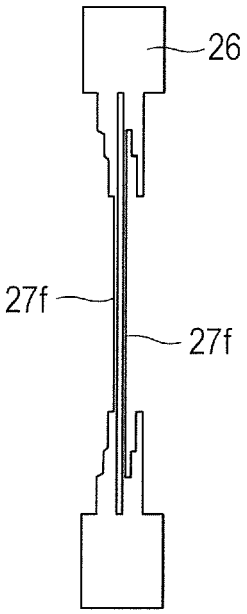
FIG. 14A, FIG. 14B and FIG. 14C are explanatory views for illustrating a configuration of a fixing apparatus according to a third embodiment of the present invention.
Figure 14B:
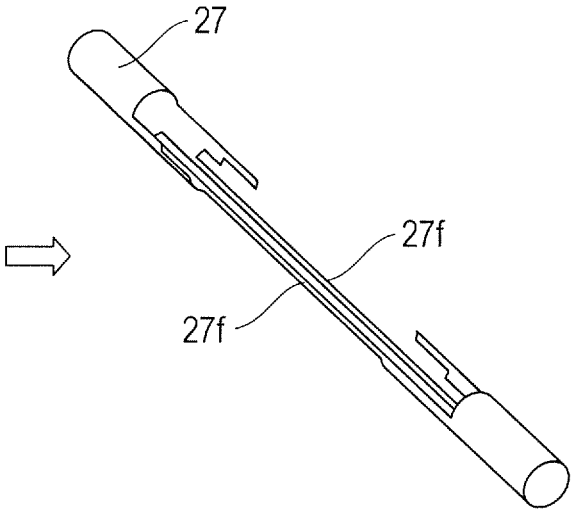
Figure 14C:
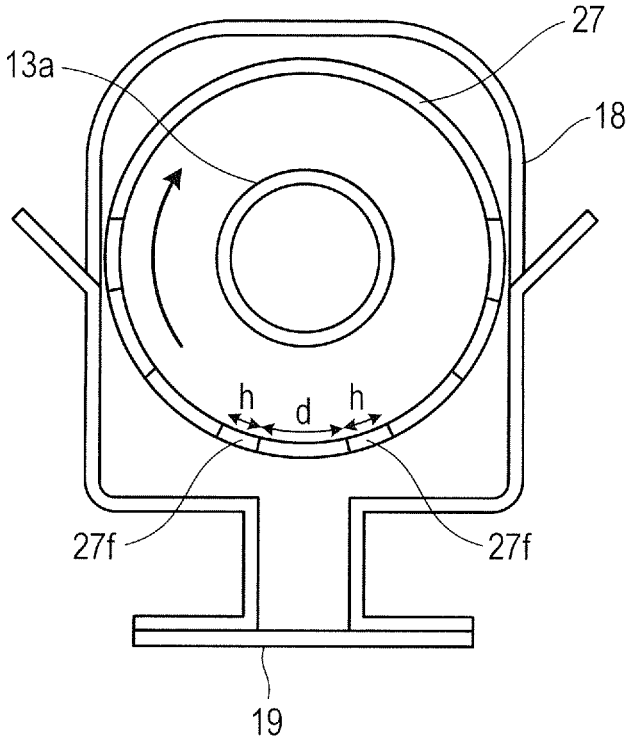

FIG. 14A to FIG. 14C are schematic views for illustrating a configuration of a fixing apparatus according to a third embodiment of the present invention. FIG. 14A is a plan view for illustrating a metal plate 26 (developed view for illustrating a rotary shutter 27). FIG. 14B is a perspective view for illustrating the rotary shutter 27. FIG. 14C is a schematic sectional view for illustrating only the heater 13*a*, the heat shielding plate 18, the pressure sliding plate 19, and the rotary shutter 27 among components of the fixing apparatus according to this embodiment. Features other than a configuration of the rotary shutter 27 are the same as those in the embodiments described above, and hence are not described.

In the first embodiment, as illustrated in FIG. 6A, the pair of bridge portions 21*f* serving as the outer frame portions are formed at both the edges in the transverse direction of the entire cutout region of the metal plate 20, that is, at positions spaced apart from each other in the circumferential direction of the rotary shutter 21. Meanwhile, in this embodiment, as illustrated in FIG. 14A, in the metal plate 26, a pair of bridge portions 27*f* are formed on both sides in a transverse direction of the opening portion corresponding to the widest recording material cutout part at the center, specifically, at positions close to each other in the circumferential direction of the rotary shutter 27. This embodiment has a feature in that the metal plate 26 including the pair of bridge portions that are formed close to each other on each side of a central cutout part in this way is prepared and subjected to the rounding process, to thereby manufacture the rotary shutter 27. Note that, the number of the bridge portions is not limited to two.

In the case where the bridge portions are formed at both the edge portions in the circumferential direction of the entire cutout region as in the first embodiment and the second embodiment, when the rotary shutter is set to the small size recording material fixing mode, not only the edge portions of the cutouts corresponding to the small size, but also the bridge portions need not necessarily be arranged to slightly block the radiant light over an entire longitudinal region in the upper half portion on the counter-fixing nip side. Thus, the heating efficiency is inevitably reduced to some extent by the bridge portions. Influence of the reduction in heating efficiency cannot be suppressed without processing the bride portions as thin as possible. However, there is also a limitation in terms of the mechanical strength.

As a countermeasure, as illustrated in FIG. 14A to FIG. 14C, the positions of the bridge portions 27*f* are changed to each side of the central cutout part, thereby being capable of preventing the bridge portions 27*f* from protruding into the region of the exposure onto the inner surface of the fixing film in the small size recording material fixing mode. As a result, even when the rotary shutter 27 is rotated in the narrow recording material fixing mode, shielding portions other than the cutout parts are not formed. Thus, a high heating efficiency can be maintained in a sheet feeding portion in this region.

Note that, when the arrangement of the bridge portions is changed in this way, a method of driving the rotary shutter needs to be devised in accordance therewith. Specifically, as illustrated in FIG. 14C, when a circular-arc length of each of the cutout parts is represented by "d", and when a circular-arc length of each of the bridge portions is represented by "h", a rotation amount of the rotary shutter needs to be switched between the following two patterns.

(1) When switching is performed to an adjacent recording material width from the widest recording material fixing position and vice versa, the rotary shutter is rotated by an amount corresponding to a circular-arc length d+h as a movement amount on the circumference of the rotary shutter.

(2) When switching is performed between the recording material widths other than the width used during the widest recording material fixing, the rotary shutter is rotated by an amount corresponding to the circular-arc length d as the movement amount on the circumference of the rotary shutter.

<Fourth Embodiment>

Figure 15A:
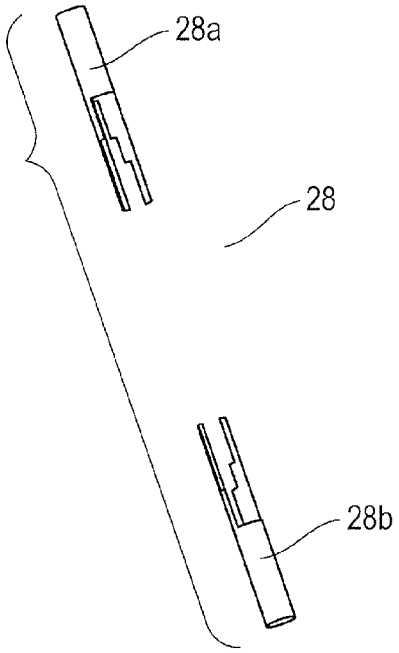
FIG. 15A and FIG. 15B are explanatory views for illustrating a configuration of a rotary shutter according to a fourth embodiment of the present invention.
Figure 15B:
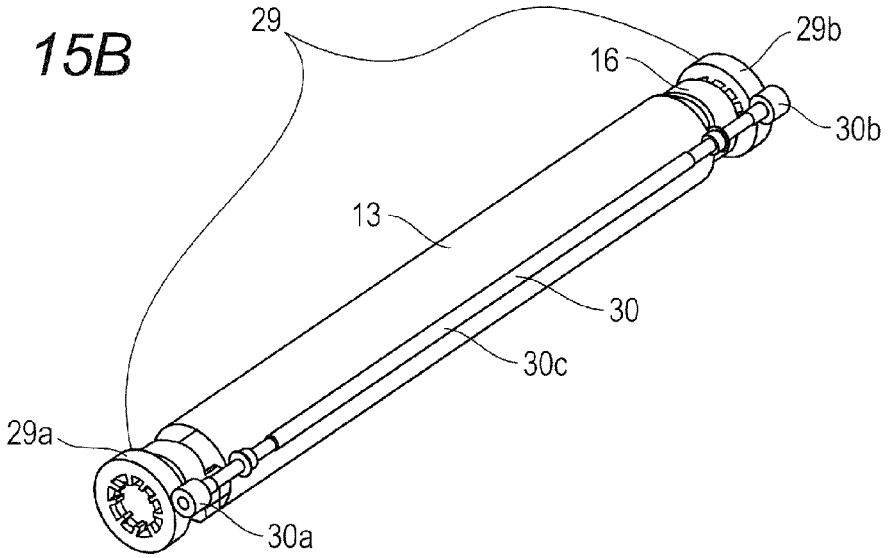

FIG. 15A and FIG. 15B are schematic views for illustrating a configuration of a fixing apparatus according to a fourth embodiment of the present invention. FIG. 15A is a perspective view for illustrating a configuration of a rotary shutter 28 of this embodiment. FIG. 15B is a schematic view for illustrating a configuration of the fixing unit of this embodiment. Features other than a configuration of the rotary shutter 28 are the same as those in the embodiments described above, and hence are not described.

As illustrated in FIG. 15A, the rotary shutter 28 of this embodiment has such a bisection configuration that the bridge portions of the rotary shutters of the embodiments described above are cut into two pairs on the right and left (are divided into one side and another side in the rotation axis direction). In such a configuration, as in the third embodiment, the bridge portions that are unnecessary for the exposure onto the sheet feeding portion in the upper half portion on the counter-fixing nip side can be omitted. In addition, spaces for forming the bridge portions need not be secured in the circular-arc portion in the cutout region of the rotary shutter. With this, the cutout parts and the opening portion at the back of the fixing nip of the rotary shutter to be arranged in the fixing unit can be reliably widened without changing the size of the fixing unit. As a result, the exposure rate can be further increased in the sheet feeding portion, and further reduced in the shielding portions at the edge portions.

In this embodiment, the rotary shutter is bisected in a longitudinal direction of the rotary shutter 28, and hence driving forces need to be respectively applied so as to rotate those two shutters. Thus, as illustrated in FIG. 15B, as a bisected rotary shutter-driving unit 29, bisectional driving gears 29*a* and 29*b* are arranged at edge portions on both sides in the longitudinal direction of the shutters. As a driving force transmission unit 30 for those gears 29*a* and 29*b*, a driving shaft 30*c* is bridged over the longitudinal direction, and driving force transmission gears 30*a* and 30*b* are arranged at both ends of the driving shaft 30*c*. In addition, a driving source, such as a motor, is arranged for any one of the gears 30*a* and 30*b* so that the other gear can be rotated in synchronization with the rotation of the one of the gears in the same phase.

<Fifth Embodiment>

With reference to FIG. 16A to FIG. 16C, FIG. 17A to FIG. 17C, FIG. 18A to FIG. 18C, and FIG. 19A and FIG. 19B, a fixing apparatus according to a fifth embodiment of the present invention is described. In this embodiment, the differences from the embodiments described above are mainly described, and the same features as those in the embodiments described above are not described. This embodiment has a feature in that the rotary shutter includes two rotary shutters that have diameters different from each other, and are arranged concentrically with each other respectively on a radially inner side and a radially outer side. The two rotary shutters are formed so that respective variations in width of opening portions in their rotation directions are reverse to each other.

Figure 16A:
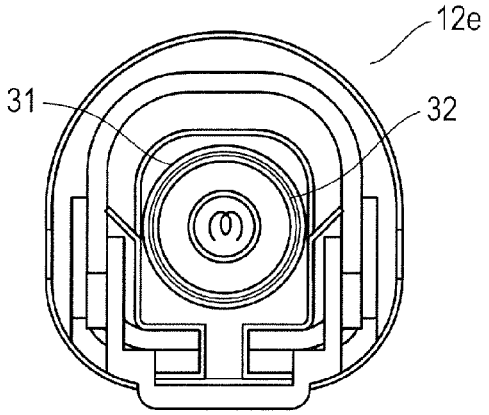
FIG. 16A, FIG. 16B and FIG. 16C are explanatory views for illustrating a configuration of a fixing apparatus according to a fifth embodiment of the present invention.
Figure 16B:
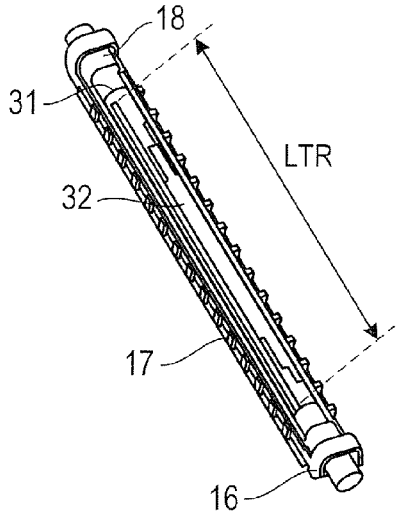
Figure 16C:
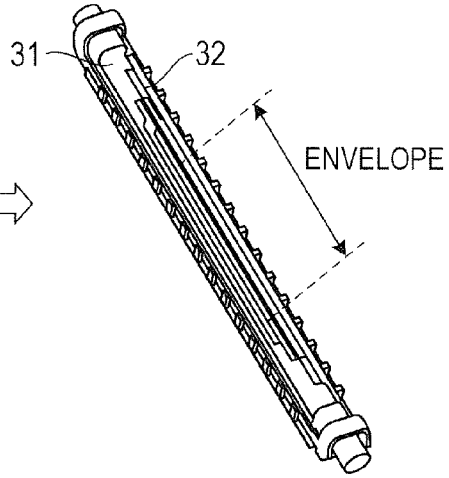

FIG. 16A to FIG. 16C are schematic views for illustrating a configuration of the fixing unit according to this embodiment. FIG. 16A is a sectional view for illustrating an upper fixing unit. FIG. 16B is a perspective view for illustrating the upper fixing unit in the LTR size setting. FIG. 16C is a perspective view for illustrating the upper fixing unit in the COM10 envelope size setting. As illustrated in FIG. 16A, the rotary shutter of the fixing unit 12*e* of this embodiment has a dual structure in which an outer rotary shutter 31 having a large outer diameter and an inner rotary shutter 32 having a slightly smaller outer diameter are combined with each other. A pattern of the cutout parts of the outer rotary shutter 31 and a pattern of the cutout parts of the inner rotary shutter 32 are formed so as to be in line symmetry with respect to an imaginary line at the central portion of the fixing nip portion in the widest recording material fixing mode (refer to FIG. 17A to FIG. 17C). At the time of a rotation operation, those shutters are rotated at the same angle but in reverse with respect to each other.

In FIG. 16B and FIG. 16C, the fixing film is removed from the upper fixing unit. In other words, FIG. 16B and FIG. 16C are illustrations of a difference of a state in the upper fixing unit at the time when the LTR size corresponding state of FIG. 16B is switched to the COM10 envelope size corresponding state of FIG. 16C. In the LTR size corresponding state of FIG. 16B, both the inner and outer rotary shutters are received in a mutually overlapping manner in a lower half region so that the upper half portion on the counter-fixing nip side is fully opened. In this state, the opening portion having the LTR size width is formed at the back of the fixing nip. In the COM10 envelope corresponding state of FIG. 16C, the opening portion having the COM10 envelope size width is formed at the back of the fixing nip, and regions of the edge portions in the upper half portion on the counter-fixing nip side are covered from both sides in the circumferential direction with the shielding parts at the edge portions of not only the COM10 envelope size cutout part, but also the B5 size cutout part and the A5 size cutout part.

Figure 17A:
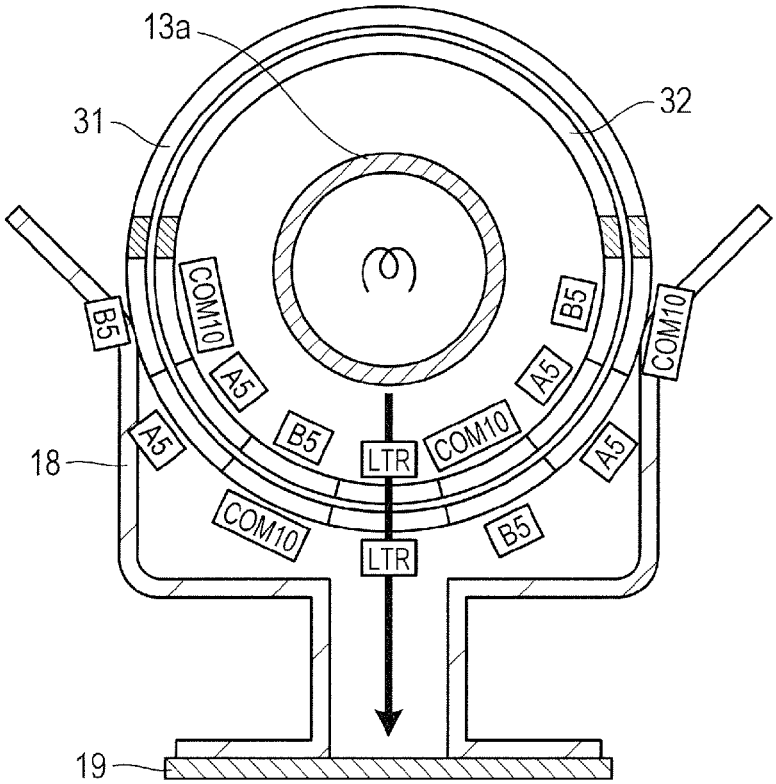
FIG. 17A, FIG. 17B and FIG. 17C are explanatory views for illustrating a configuration of a rotary shutter according to the fifth embodiment of the present invention.
Figure 17B:
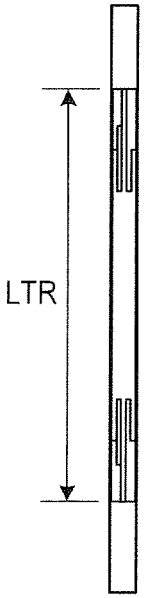
Figure 17C:
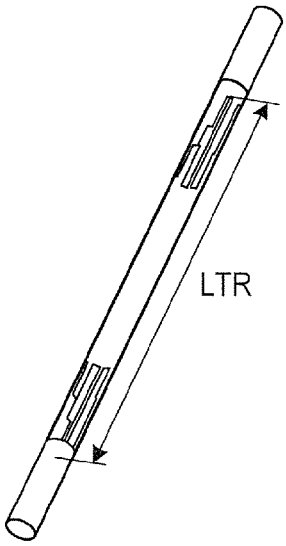

FIG. 17A to FIG. 17C and FIG. 18A to FIG. 18C are schematic explanatory views for illustrating a relative rotation operation between the rotary shutters 31 and 32, in which only the members therearound that are necessary for the description are illustrated. FIG. 17A is a sectional view for illustrating, of the members in the basic configuration of FIG. 16A, only the members that are necessary for the description, and illustrating a state in which the LTR size sheets are selected. Each of the rotary shutters 31 and 32 is arranged in such a phase that the LTR size cutout part is arranged at the lowermost end, that is, the position facing the fixing nip. The rotary shutters 31 and 32 under this state are illustrated in the plan view of FIG. 17B and the perspective view of FIG. 17C. As illustrated in FIG. 17B and FIG. 17C, the opening portions each having a length corresponding to the LTR width are arranged on the lower surface side facing the fixing nip. As illustrated in FIG. 17A, in the overall arrangement in the rotary shutters in this state, the cutout parts are arrayed in the outer rotary shutter 31 and the inner rotary shutter 32 as represented by the imaginary labels that are arranged so as to respectively indicate the names of the sheet sizes. In other words, in each of the rotary shutters, the cutout parts corresponding to the sheet sizes other than the LTR size are doubly arranged in the same order on each of the right and left of the LTR size cutout part as a center. Specifically, in the inner rotary shutter 32, the cutout parts are arranged in such a clockwise order that the corresponding sheet widths are gradually reduced from the right to the left in the drawing sheet of FIG. 17A. Meanwhile, in the outer rotary shutter 31, the cutout parts are arranged in such a counterclockwise order that the corresponding sheet widths are gradually reduced from the left to the right.

Figure 18A:
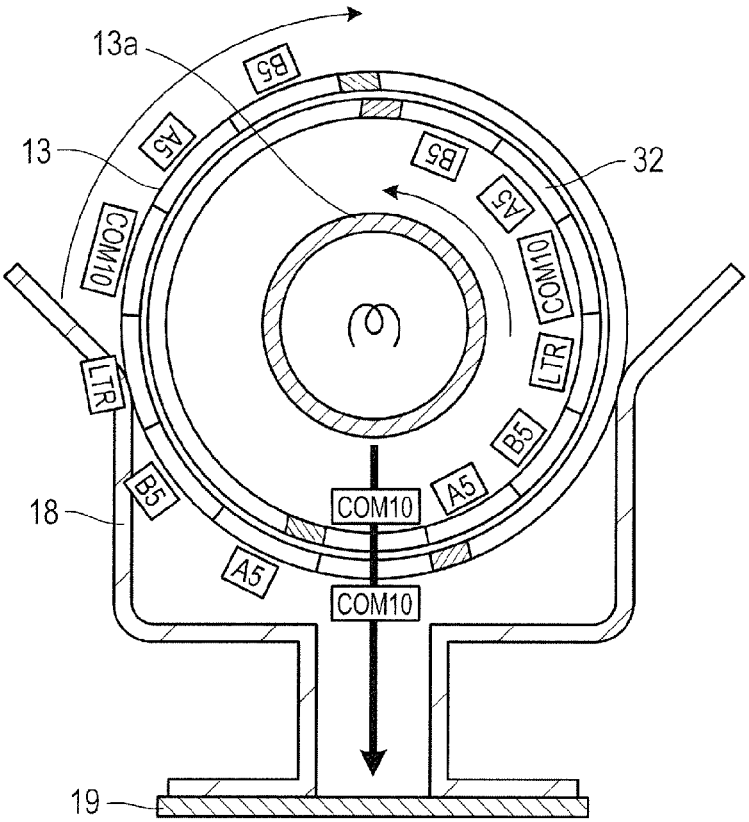
FIG. 18A, FIG. 18B and FIG. 18C are explanatory views for illustrating the configuration of the rotary shutter according to the fifth embodiment of the present invention.
Figure 18B:
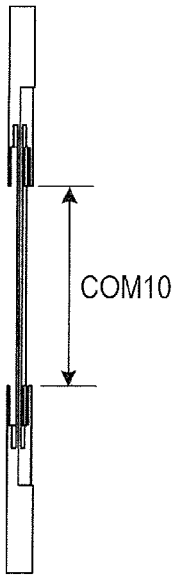
Figure 18C:
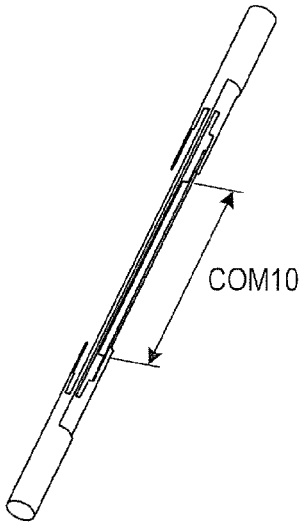

FIG. 18A is a sectional view for illustrating a rotary shutter switched state when the COM10 size sheets are selected from the above-mentioned LTR size sheet state. The inner rotary shutter 32 and the outer rotary shutter 31 are rotated in reverse with respect to each other, specifically, counterclockwise and clockwise respectively as indicated by the arrows in FIG. 18A. With this, the inner rotary shutter 32 and the outer rotary shutter 31 are arranged in such a phase that the COM10 size cutout parts of the rotary shutters 31 and 32 are arranged at the lowermost end, that is, the position facing the fixing nip. The rotary shutters 31 and 32 under this state are illustrated in the plan view of FIG. 18B and the perspective view of FIG. 18C. As illustrated in FIG. 18B and FIG. 18C, the opening portions of the rotary shutters 31 and 32, each having the length corresponding to the COM10 width, are arranged in a mutually overlapping manner on the lower surface side facing the fixing nip. As illustrated in FIG. 18A, in the overall arrangement in the rotary shutters in this state, the cutout parts are arrayed in the rotary shutters 31 and 32 as represented by the imaginary labels that are arranged so as to respectively indicate the names of the sheet sizes. The respective COM10 size cutout parts are arranged at the lowermost position.

As a result of the rotation operation described above, as understood from FIG. 18B and FIG. 18C, only the opening portion having the length corresponding to the COM10 width is arranged at the central portion of the fixing nip, and the radiant light onto both the edge portions in the longitudinal direction with respect to the central portion is reflected mainly by an inner surface of the inner rotary shutter 32. In this way, the heating width is limited to the COM10 envelope size. Meanwhile, as illustrated in FIG. 18A, in the upper right portion and the upper left portion in the region on the counter-fixing nip side, a part of each of the rotary shutters 31 and 32, which includes the B5 size cutout part, the A5 size cutout part, and the COM10 envelope size cutout part, protrudes upward with respect to the upper right and left edges of the heat shielding plate 18. Thus, the radiant light from the halogen heater 13*a* directed toward the edge portions in the longitudinal direction of the inner surface of the fixing film is partially blocked, and hence the heating of the edge portions of the fixing film is also partially restricted on the counter-fixing nip side. In other words, in the COM10 envelope size fixing mode in which the temperatures at the edge portions need not be raised, the radiant light emitted in the direction toward the regions at the edge portions of the inner surface of the fixing film is blocked not only in the fixing nip portion, but also on the counter-fixing nip side. With this, the temperature rises at the edge portions can be significantly suppressed.

With this configuration, opening portions having the same recording material width always overlap with each other in the slit portion at the back of the fixing nip, and hence necessary exposure regions are secured therein. At the same time, the cutout parts of the rotary shutters 31 and 32 protrude from both the upstream and downstream sides with respect to the fixing nip into the opening region above the heat shielding plate 18 so as to shield the exposure region in the upper half portion on the counter-fixing nip. With this, in comparison with the first embodiment in which the edge portion shielding parts are formed of the single shutter, substantially a double area can be covered in this embodiment. Thus, the effect of shielding the edge portions can be substantially doubled.

Figure 19A:
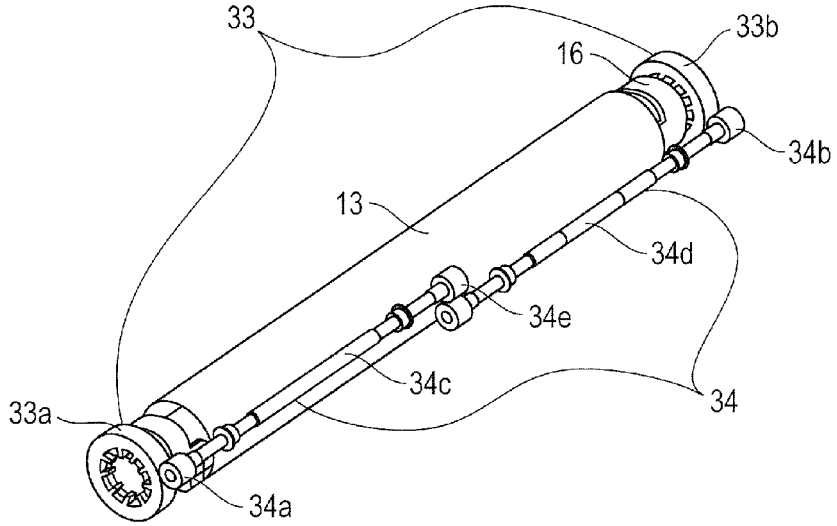
FIG. 19A is an explanatory view for illustrating another configuration of the rotary shutter according to the fifth embodiment of the present invention.

FIG. 19A is a perspective view for illustrating an example of a configuration of a driving mechanism for the rotary shutters 31 and 32 of this embodiment. In order to operate the two rotary shutters 31 and 32 as described above, the rotary shutters 31 and 32 need to be driven simultaneously in reverse with respect to each other. Each of the rotary shutters 31 and 32 has such a configuration that cylindrical edge portions at both ends in the longitudinal direction are coupled to each other with the bridge portions so that each of the shutters can be entirely rotated by a rotational driving force transmitted to one of the edge portions. As a double shutter driving unit 33, driving gears 33*a* and 33*b* are arranged at edge portions on one side of the rotary shutters 31 and 32. Edge portions on the other side of the rotary shutters 31 and 32 are supported by bearing members (not shown).

As a driving force transmission unit 34 configured to allow the driving gears 33*a* and 33*b* to be driven and rotated in reverse with respect to each other, two driving shafts 34*c* and 34*d* are bridged over the longitudinal direction. A driving force transmission gear 34*a* configured to mesh with the driving gear 33*a* is arranged at one end of a driving shaft 34*c*, and a driving force transmission gear 34*b* configured to mesh with the driving gear 33*b* is arranged at one end of a driving shaft 34*d*. At a central portion in the longitudinal direction of the rotary shutter unit, the driving shafts 34*c* and 34*d* mesh with each other through intermediation of a train 34*e* of reverse rotation gears that are arranged at other ends of the driving shafts 34*c* and 34*d*. When the rotational driving force is transmitted from a driving source such as a motor (not shown) to any one of the reverse rotation gears in the train 34*e*, the double inner and outer shutters can be driven and rotated simultaneously in a reverse phase.

Figure 19B:
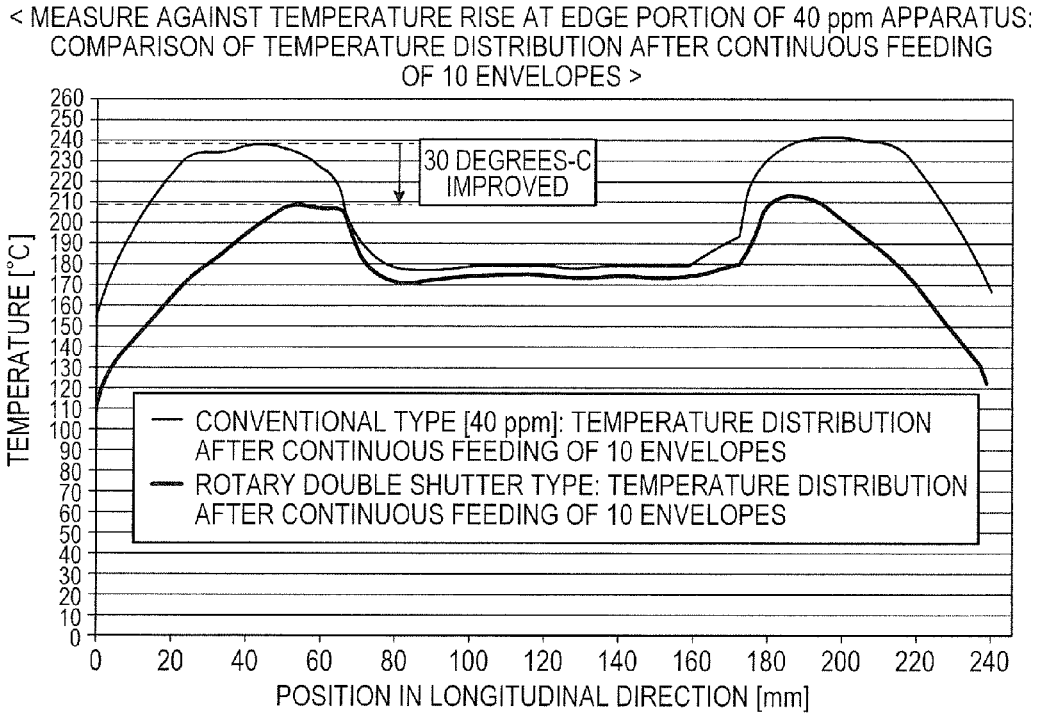
FIG. 19B is an explanatory graph for showing the performance of the rotary shutter according to the fifth embodiment of the present invention.

FIG. 19B is a graph for showing the results of advantage verification carried out in a case where the fixing apparatus according to this embodiment, which is configured as described above, is mounted in an image forming apparatus. In other words, FIG. 19B is a graph for showing temperature distributions in the longitudinal direction of the fixing unit in the COM10 envelope continuous feeding mode. In the verification, the high-speed fixing apparatus of 40 ppm is configured as described above, and levels of the temperature rises at the edge portions immediately after continuous feeding of ten COM10 envelopes are measured. The temperature distributions along the longitudinal direction of the fixing unit shown in the graph are obtained by measuring temperatures at a central portion of a lateral wall of the fixing unit. The thin curve in the graph represents results of performing, in the LTR size setting, the continuous feeding of ten COM10 envelopes, that is, the results of measurement under a condition substantially the same as that in the related art, in which measures for increasing the productivity in the case of the small size are not taken.

In the configuration of the related art, with respect to a preset fixing temperature of 170 degrees-C, temperatures at a central sheet feeding portion are maintained at substantially 180 degrees-C. Meanwhile, temperatures at both the edge portions rise up to approximately 240 degrees-C as a result of the continuous feeding of the COM10 envelopes. In this way, a difference of substantially 60 degrees-C occurs. The temperature of 240 degrees-C is significantly higher than the heatproof upper limit temperature of the fixing film, which is substantially 220 degrees-C. As a countermeasure, in actually available products, the printing speed needs to be significantly reduced.

Meanwhile, when the double rotary shutter of this embodiment is set so that the cutout parts are set to the COM10 envelope size, in the upper half portion on the counter-fixing nip side, exposure rates at the edge portions in the longitudinal direction are reduced to substantially half of that in the case of using the single shutter. With this, the results as indicated by the thick curve in the graph are obtained. In this embodiment, the temperature rises at the edge portions are reduced by substantially 30 degrees-C, which shows that an advantage substantially twice as great as the advantage obtained in the case of using the single shutter can be obtained, and that the restriction on the continuous feeding against the temperature rises at the edge portions can be significantly reduced.

<Sixth Embodiment>

With reference to FIG. 20A to FIG. 20D, a fixing apparatus according to a sixth embodiment of the present invention is described. In this embodiment, differences from the embodiments described above are mainly described, and the same features as those in the embodiments described above are not described. This embodiment has a feature in that a position of a rotation center of the rotary shutter is offset from the center of the heater toward the fixing nip side.

Figure 20A:
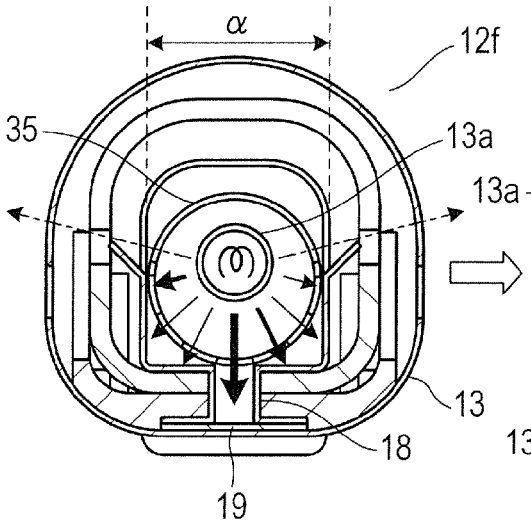
FIG. 20A, FIG. 20B, FIG. 20C and FIG. 20D are explanatory views for illustrating a configuration of a fixing apparatus according to a sixth embodiment of the present invention.
Figure 20B:
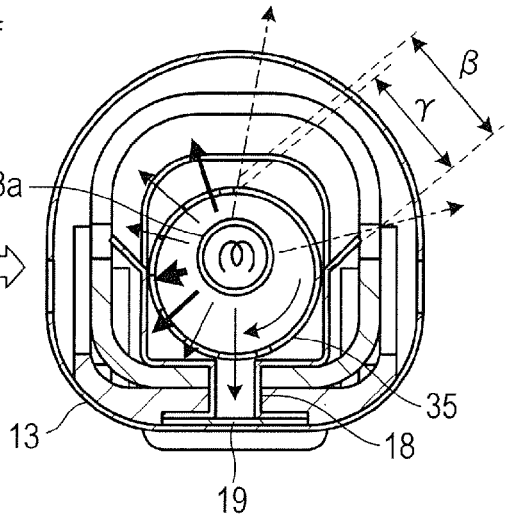

FIG. 20A and FIG. 20B are schematic sectional views for illustrating the configurations of an eccentric rotary shutter 35 and an eccentric rotary shutter incorporating fixing unit 12*f* using the same. As illustrated in FIG. 20A, in this embodiment, the rotation center of the rotary shutter is arranged so as to be offset toward the fixing nip side with respect to the configuration in which the rotation center matches with the center of the heater as in the first embodiment within an allowable range in terms of the interior space of the unit and heat shielding performance of the shutter with respect to the heater. FIG. 20A is a cross-sectional view of a state in which the widest recording material fixing mode is set. Under this state, there is substantially no difference from the configuration of the first embodiment in exposure rate that can be adjusted by using the shutter in the upper half portion on the counter-fixing nip side. However, when a setting is changed to the COM10 envelope size fixing mode as illustrated in FIG. 20B, the fully opened portion in the longitudinal direction, which corresponds to substantially half of the circumference of the rotary shutter, is rotated and moved to a position lower than that in the case of the first embodiment, that is, sunk to a position lower than the height at which the exposure is restricted by the heat shielding plate 18. In this case, the width of the full opening in the longitudinal direction of the rotary shutter can be limited to a width $\gamma$ that is smaller than the width $\beta$ in the case where the rotary shutter is rotated about the same rotation center as the heater (first embodiment). Thus, the exposure amounts at the edge portions are reduced overall, and hence the temperature rises at the edge portions can be more effectively suppressed.

Also in the regions corresponding to the other cutout parts, although the widths of respective cutout parts are the same as those in the first embodiment, the radiant light is blocked at positions closer to the heater 13*a*. Thus, angular fields when viewed from the center of the heater with respect to the shielding portions are increased. Therefore, a larger amount of the radiant light is blocked so as to enhance the efficiency in reducing the exposure amount at the edge portions. In contrast, a larger amount of the radiant light passes through the central sheet feeding portion. With this, higher performance of fixing in the sheet feeding portion and a greater advantage of suppressing the temperature rises at the edge portions can be obtained at once.

In this context, there is considered a case where the fixing unit according to this embodiment is formed by changing the arrangement of the components of the fixing unit of the first embodiment. Originally, in the configuration of the first embodiment, ample transverse widths of the cutout parts of the rotary shutter are secured. Thus, in the examples of FIG. 20A and FIG. 20B, even when the rotary shutter is moved so as to be offset as it is, sufficient opening widths are maintained with respect to a transverse width of the slit opening portion at the back of the fixing nip. Basically, the rotary shutter of the first embodiment is optimized so that, when the rotary shutter is arranged concentrically with the heater, each of the cutout parts matches with the angular field corresponding to the slit width G that is set at the position spaced apart from the center of the heater by the distance F. Thus, when the rotary shutter of the first embodiment is offset as it is toward the fixing nip, the transverse width of each of the cutout parts on the shutter side is deficient with respect to the transverse width of the slit opening portion at the back of the fixing nip. As a countermeasure, in accordance with the offset, the transverse width of each of the cutout parts of the shutter needs to be increased.

Figure 20C:
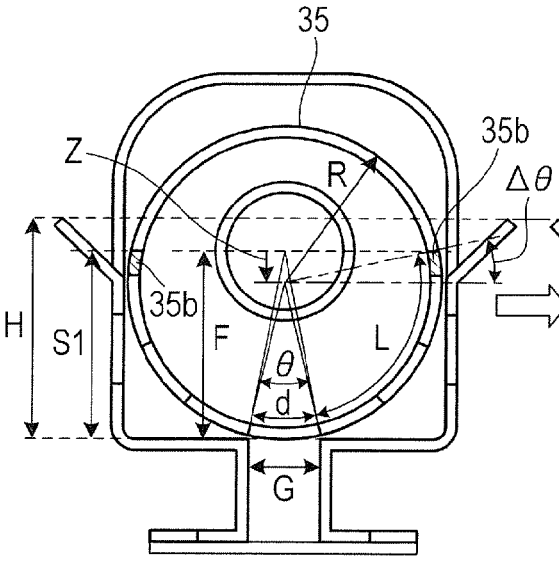

FIG. 20C is a schematic sectional view for illustrating a configuration in which the rotary shutter is offset toward the fixing nip by the distance Z without changing the cutout width d in the transverse direction of the shutter, which is optimized under the state in which the heater and the rotary shutter are arranged concentrically with each other. Note that, FIG. 20C is an illustration of the widest recording material fixing mode. In this case, the opening width d of each of the cutout parts of the shutter is deficient with respect to the transverse width G of the slit opening portion at the back of the fixing nip. Thus, there is a risk in that a possible exposure amount of the radiant light cannot be achieved. However, the height S1 of the upper end surfaces of the cutout part forming region of the rotary shutter 35, which is measured from the slit forming surface of the heat shielding plate 18, is reduced by the distance Z from the height S before the offset, which is described in the first embodiment. Thus, the position of the rotation center of the rotary shutter is sufficiently lower than the radiant light restriction height H of the heat shielding plate 18. Thus, when an angular field when viewed from the center of the rotary shutter with respect to the height corresponding to the distance Z is represented by Δθ, the cutout part forming region can be elongated by a circular-arc length corresponding to the angular field Δθ.

Figure 20D:
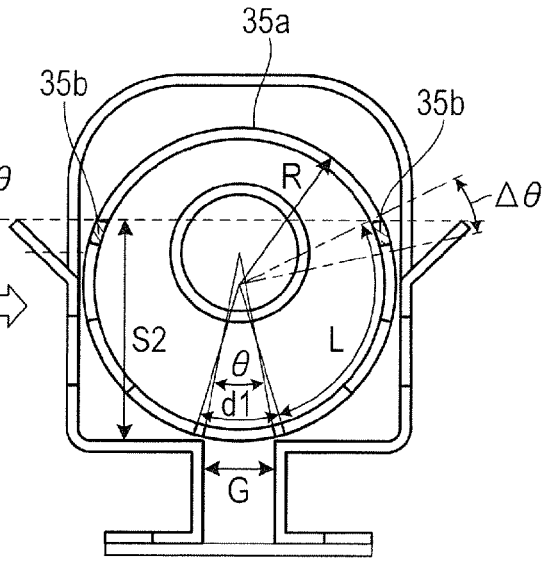

FIG. 20D is a schematic sectional view for illustrating a rotary shutter 35*a* having the increased circular-arc length L1 that is obtained by increasing the circular-arc length L of the cutout part forming region by the circular-arc length corresponding to the angular field Δθ, and the transverse width d1 that is obtained by increasing the transverse width d of each of the cutout parts without changing a thickness of bridge portions 35*b*. Note that, when fixing on the small size sheets is performed with this configuration, an advantage of a higher radiant light blocking rate, which is obtained by the offset arrangement described above, and the advantage obtained by increasing the width d of each of the cutout parts to the width d1, can be synergistically exerted in the shielding portions at the edge portions in the upper half portion on the counter-fixing nip side after the rotary shutter 35*a* is rotated. With this, a much greater advantage of suppressing the temperature rises at the edge portions can be obtained.

<Seventh Embodiment>

With reference to FIG. 21A to FIG. 21F, a fixing apparatus according to a seventh embodiment of the present invention, specifically, components in the upper fixing unit are described. In this embodiment, differences from the embodiments described above are mainly described, and the same features as those in the embodiments described above are not described. In the fixing apparatus according to the first to sixth embodiments, the radiant light is directly emitted onto the fixing nip portion. In contrast, in the fixing apparatus according to this embodiment, the radiant light is not directly emitted onto the fixing nip portion.

Figure 21A:
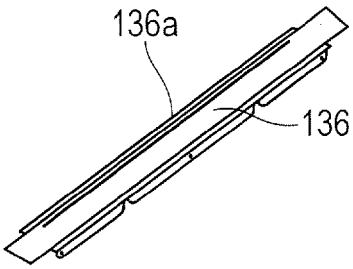
FIG. 21A, FIG. 21B, FIG. 21C, FIG. 21D, FIG. 21E and FIG. 21F are explanatory views for illustrating a configuration of a fixing apparatus according to a seventh embodiment of the present invention.

FIG. 21A is a perspective view for illustrating a reflecting plate 136 (first shielding member). The reflecting plate 136 includes an elongated slit 136*a* formed along its longitudinal direction.

Figure 21B:
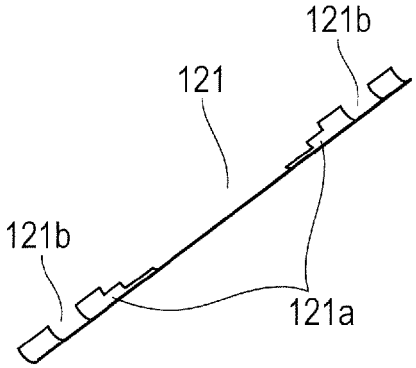

FIG. 21B is a perspective view for illustrating a rotary shutter 121 (second shielding member). The rotary shutter 121 is configured to be rotatable around the heater 13*a* about a rotation axis extending in the recording material width direction. The rotary shutter 121 includes a cutout portion (slit) 121*a* formed in accordance with the sheet sizes, and edge portion interference preventing cutout portions 121*b* formed respectively on both right and left sides in the longitudinal direction and configured to prevent interference with reflecting portions between edge portions of the reflecting plate 136 and end portions of the elongated slit 136*a* at the time of rotation. The rotary shutter 121 is a member including the cutout portions 121*a* and 121*b*, and has a circular-arc shape in cross-section when viewed in the longitudinal direction. The cutout portion 121*a* forms, between the fixing film 13 and the heater 13*a*, pairs of shielding portions configured to form pairs of walls that block the radiation heat over a predetermined range in the recording material conveying direction, and over a predetermined range in the recording material width direction on the inner side with respect to the edge portions of the inner peripheral surface of the fixing film 13. The cutout portion 121*a* is narrower than a recording material having the largest size among recording materials that can be conveyed through the fixing apparatus. The rotary shutter 121 is configured to be movable between a position (first position) at which the shielding portions are arranged in a shielding region (first shielding region) of the reflecting plate 136, and a position (second position) at which the shielding portions are out of the first shielding region. When the rotary shutter 121 is arranged at the second position, the shielding portions form other shielding regions (second shielding regions) independently of the reflecting plate 136. The shielding regions formed respectively of the pairs of shielding portions vary from each other in width in the recording material width direction along the recording material conveying direction. The respective widths in the recording material width direction in the shielding regions of the pairs of shielding portions may vary from each other in a stepwise manner (stepped pattern) along the recording material conveying direction as illustrated in FIG. 21B, or may vary from each other linearly as illustrated in FIG. 12A. The cutout portion 121*a* of the rotary shutter 121 may include a plurality of cutouts that are different from each other in width in the longitudinal direction of the film, and are arrayed along the rotation direction of the fixing film 13.

Figure 21C:
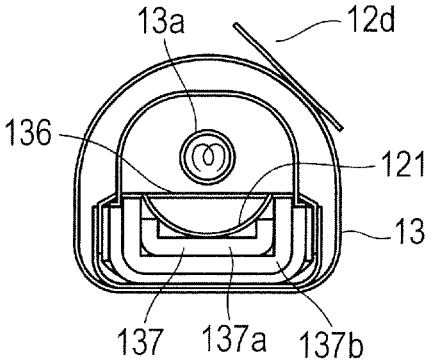

FIG. 21C is a schematic sectional view for illustrating a state in which the rotary shutter 121 is received in an interior space (receiving portion) surrounded by the reflecting plate 136 and a pressure stay 137, that is, a state in which the radiant light of the heater 13*a* is not blocked by the rotary shutter 121. At the time of executing a process of fixing on the recording material having the largest size of the recording materials that can be conveyed through the fixing apparatus, the rotary shutter 121 is moved to the first position. The pressure stay 137 of this embodiment is different in configuration from the pressure stay 37 as the related art illustrated in FIG. 4A. As illustrated in FIG. 4A, in the configuration of the related art, the two metal plates 37*a* and 37*b* each having the U-shape in cross-section are combined with each other in a manner that respective opening portions face with each other, to thereby form a hollow portion. However, in the configuration of this embodiment, a receiving space for the rotary shutter 121 is needed. Thus, in this embodiment, as illustrated in FIG. 21C, two metal plates 137*a* and 137*b* each having a U-shape in cross-section are combined with each other in a manner that respective opening portions are oriented to the same side (opened upward), and are adjusted in height so that the rotary shutter 121 can be received. Note that, the rotary shutter 121 can be received also in the configuration of the related art of FIG. 4A when, for example, an opening portion that is large enough to receive the shutter is formed at a central portion of an upper surface of the inner stay.

Figure 21D:
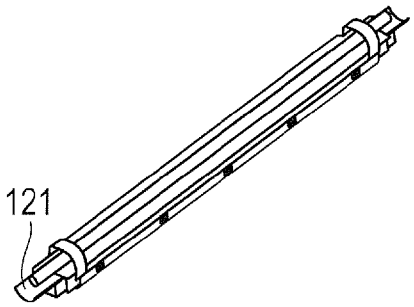

FIG. 21D is a perspective view for illustrating a state in which the fixing film 13 is removed from the configuration of the upper fixing unit of this embodiment. In other words, FIG. 21D is a perspective view for illustrating the state illustrated in FIG. 21C, that is, a state in which the rotary shutter 121 is received in the receiving portion. There is no significant difference in configuration from the configuration of the related art illustrated in FIG. 4C except that the elongated slit 136*a* is formed in the reflecting plate 136.

Figure 21E:
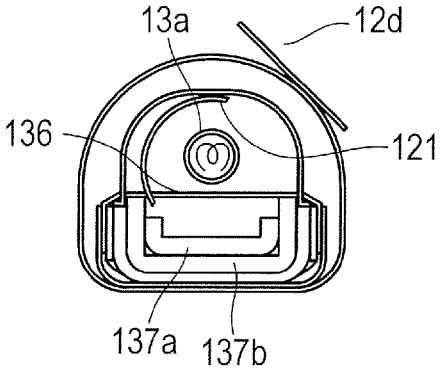

FIG. 21E is a schematic sectional view for illustrating a state in which the rotary shutter 121 is arranged at a light blocking position in the mode of performing fixing on the COM10 envelope size sheets having the smallest width size that can be subjected to fixing with the fixing apparatus according to this embodiment. As in the first to sixth embodiments, in the configurations in which the fixing nip portion is also exposed with the radiant light, basically, the rotary shutter cannot be rotated at an angle more than 90°. However, in this embodiment, the fixing nip portion need not be directly exposed, and hence both the shielding area and the rotation angle can be increased. In this embodiment, the rotation angle is increased up to substantially 120°. At the time of executing a process of fixing on the recording materials that are narrower than the recording material having the largest size that can be conveyed through the fixing apparatus, specifically, fixing on the COM10 envelopes, the rotary shutter 121 is moved to the second position.

Figure 21F:
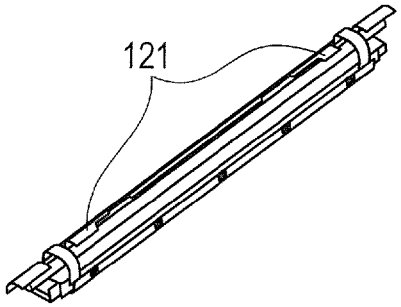

FIG. 21F is a perspective view for illustrating another state in which the fixing film 13 is removed from the configuration of the upper fixing unit of this embodiment. In other words, FIG. 21F is a perspective view for illustrating a state in which the rotary shutter 121 illustrated in FIG. 21E is arranged at a light blocking position in the COM10 envelope size fixing mode.

Through employment of the above-mentioned configuration of this embodiment, an advantage of suppressing the temperature rises at the edge portions, which is equivalent to or greater than that in the first embodiment, can be obtained.

<Eighth Embodiment>

With reference to FIG. 22A to FIG. 22F, a fixing apparatus according to an eighth embodiment of the present invention, specifically, components in the upper fixing unit are described. In this embodiment, differences from the embodiments described above are mainly described, and the same features as those in the embodiments described above are not described. In the fixing apparatus according to the first to sixth embodiments, the radiant light is emitted onto the fixing nip portion. In contrast, in the fixing apparatus according to this embodiment, the radiant light is not emitted onto the fixing nip portion. Further, unlike the seventh embodiment, the radiant light is blocked by two rotary shutters.

Figure 22A:
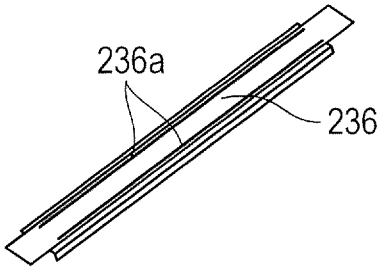
FIG. 22A, FIG. 22B, FIG. 22C, FIG. 22D, FIG. 22E and FIG. 22F are explanatory views for illustrating a configuration of a fixing apparatus according to an eighth embodiment of the present invention.

FIG. 22A is a perspective view for illustrating a reflecting plate 236 having double slits for rotary shutter passage. The reflecting plate 236 includes two elongated slits 236*a* formed along its longitudinal direction.

Figure 22B:
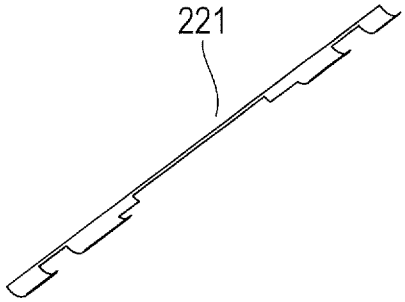

FIG. 22B is a perspective view for illustrating an inner rotary shutter 221 having a cutout configured to prevent interference with edge portions of the reflecting plate. In the fixing apparatus according to this embodiment, the rotary shutter 121 of the seventh embodiment is arranged so as to serve as an outer rotary shutter, and the rotary shutter 221 configured symmetrically with the rotary shutter 121 is arranged so as to serve as an inner rotary shutter. The rotary shutter 221 is arranged so as to be rotatable in reverse to the rotary shutter 121 along a rotational trajectory having a radius slightly smaller than a rotational trajectory of the rotary shutter 121.

Figure 22C:
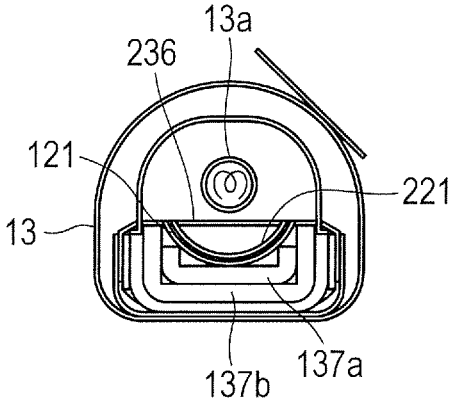

FIG. 22C is a schematic sectional view for illustrating a state in which the rotary shutters 121 and 221 are received in an interior space surrounded by the reflecting plate 236 and the pressure stay 137, that is, a state in which the radiant light of the heater 13*a* is not blocked by the rotary shutters 121 and 221.

Figure 22D:
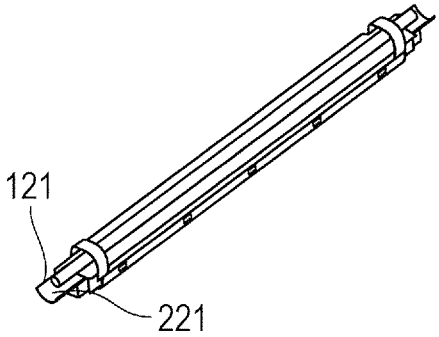

FIG. 22D is a perspective view for illustrating a state in which the fixing film 13 is removed from the configuration of the upper fixing unit of this embodiment. In other words, FIG. 22D is a perspective view for illustrating the state illustrated in FIG. 22C, that is, a state in which the rotary shutters 121 and 221 are received in the receiving portion.

Figure 22E:
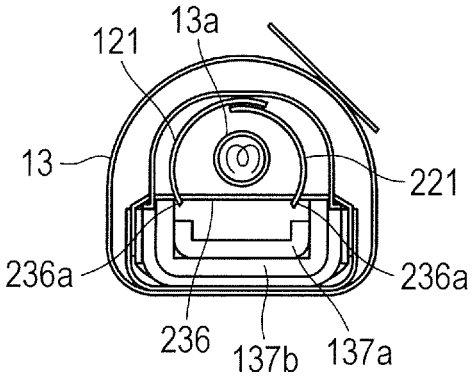

FIG. 22E is a schematic sectional view for illustrating a state in which the rotary shutters 121 and 221 are arranged at a light blocking position in the mode of performing fixing on the COM10 envelope size sheets having the smallest width size that can be subjected to fixing with the fixing apparatus according to this embodiment. In the configuration of this embodiment, the entire periphery of the heater 13*a* is surrounded by the two rotary shutters 121 and 221 and the reflecting plate 236.

Figure 22F:
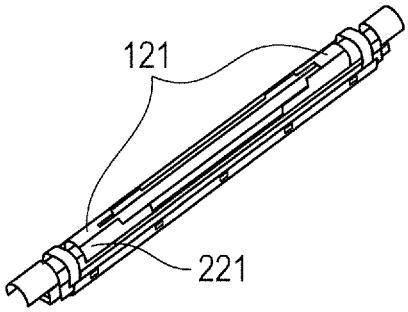

FIG. 22F is a perspective view for illustrating another state in which the fixing film 13 is removed from the configuration of the upper fixing unit of this embodiment. In other words, FIG. 22F is a perspective view for illustrating a state in which the rotary shutters 121 and 221 illustrated in FIG. 22E are arranged at a light blocking position in the COM10 envelope size fixing mode.

In the fixing apparatus according to this embodiment, the two rotary shutters 121 and 221 are combined with each other so as to form an opening portion (radiant light emitting region) necessary for fixing on sheets of desired sizes. As in this embodiment and the seventh embodiment, in the configuration in which the fixing nip portion is not directly heated by the radiation heat, the shielding area and the rotation angle can be further increased in comparison with those in the first to sixth embodiments. However, the rotary shutters need to be received in the interior space surrounded by the pressure stay 137 and the flat reflecting plate 136, and hence there is an upper limit of the allowable height. Specifically, the rotation angle of 90° of the single rotary shutter cannot be increased to more than 120°. As a countermeasure, in this embodiment, based on the technical idea similar to that in the fifth embodiment, the two large and small rotary shutters are controlled so as to be rotated in phases reverse to each other. With this, an advantage of shielding substantially twice as great as that obtained in the configuration of the seventh embodiment can be obtained. As a result, the advantage of suppressing the temperature rises at the edge portions, which is equivalent to or greater than that in the fifth embodiment, can be obtained.

<Ninth Embodiment>

With reference to FIG. 23A to FIG. 23F, a fixing apparatus according to a ninth embodiment of the present invention, specifically, components in the upper fixing unit are described. In this embodiment, differences from the embodiments described above are mainly described, and the same features as those in the embodiments described above are not described. In the fixing apparatus according to the first to sixth embodiments, the radiant light is emitted onto the fixing nip portion. In contrast, in the fixing apparatus according to this embodiment, the radiant light is not emitted onto the fixing nip portion. Further, the configuration of the reflecting plate is different from those of the seventh and eighth embodiments.

Figure 23A:
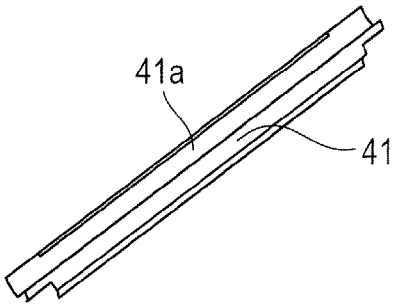
FIG. 23A, FIG. 23B, FIG. 23C, FIG. 23D, FIG. 23E and FIG. 23F are explanatory views for illustrating a configuration of a fixing apparatus according to a ninth embodiment of the present invention.
Figure 23B:
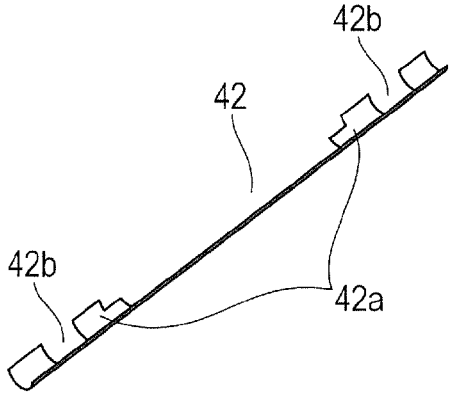

FIG. 23A is a perspective view for illustrating a sectionally M-shaped reflecting plate 41. The sectionally M-shaped reflecting plate 41 of this embodiment is obtained through deformation of the flat reflecting plate of the seventh and eighth embodiments into an M-shape in cross-section. The reflecting plate 41 includes an elongated M-shaped slope portion slit 41*a* formed along its longitudinal direction. FIG. 23B is a perspective view for illustrating an edge cutout rotary shutter 42 for the sectionally M-shaped reflecting plate 41. Unlike the rotary shutters for the flat reflecting plates of the seventh and eighth embodiments, the rotary shutter 42 includes shielding portions formed on both sides of a cutout portion 42*a* in the longitudinal direction, and each having a longer circular-arc length and a larger shielding area, and cutout portions 42*b* similarly formed respectively on both the sides in the longitudinal direction so as to secure a larger region of preventing the interference with edge portions of the reflecting plate.

Figure 23C:
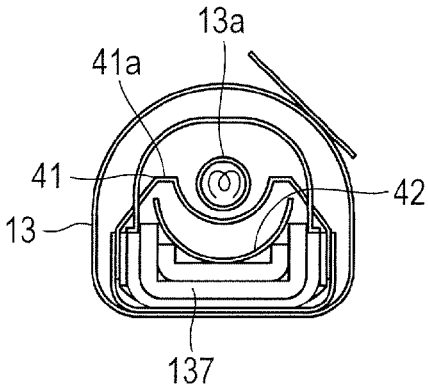

FIG. 23C is a schematic sectional view for illustrating a state in which the rotary shutter 42 is received in an interior space surrounded by the reflecting plate 41 and the pressure stay 137, that is, a state in which the radiant light of the heater 13*a* is not blocked by the rotary shutter 42.

Figure 23D:
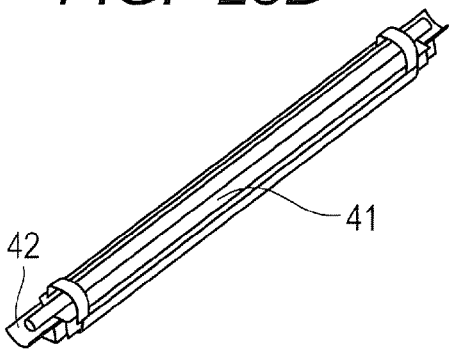

FIG. 23D is a perspective view for illustrating a state in which the fixing film 13 is removed from the configuration of the upper fixing unit of this embodiment. In other words, FIG. 23D is a perspective view for illustrating the state illustrated in FIG. 23C, that is, a state in which the rotary shutter 42 is received in the receiving portion.

Figure 23E:
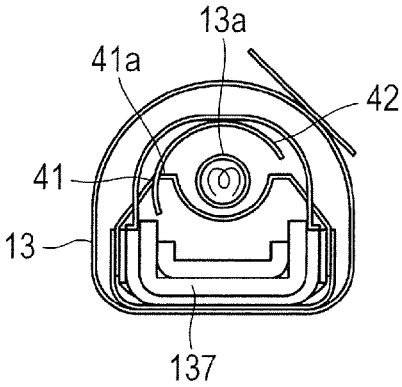

FIG. 23E is a schematic sectional view for illustrating a state in which the rotary shutter 42 is arranged at a light blocking position in the mode of performing fixing on the COM10 envelope size sheets having the smallest width size that can be subjected to fixing with the fixing apparatus according to this embodiment.

Figure 23F:
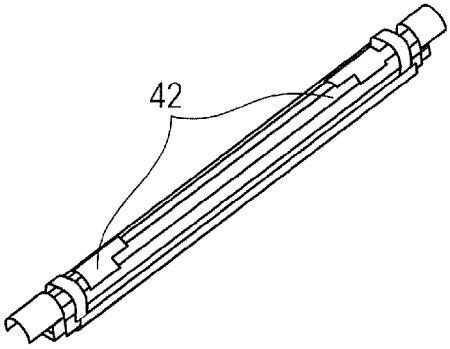

FIG. 23F is a perspective view for illustrating another state in which the fixing film 13 is removed from the configuration of the upper fixing unit of this embodiment. In other words, FIG. 23F is a perspective view for illustrating a state in which the rotary shutter 42 illustrated in FIG. 23E is arranged at a light blocking position in the COM10 envelope size fixing mode.

As is clear from the cross-sectional configuration of FIG. 23C, in this embodiment, the reflecting plate 41 is formed into the M-shape in cross-section, and hence the space between the reflecting plate and the pressure stay, which forms the receiving space for the rotary shutter, is enlarged in comparison with those in the configurations of the seventh and eighth embodiments. In other words, the reflecting plate 41 is arranged so that the receiving portion for the rotary shutter 42 is formed around the heater 13*a* along a movement trajectory of the rotary shutter 42. In conformity with apexes of the M-shape in cross-section of the reflecting plate 41, both edge portions in the circumferential direction of the rotary shutter 42 are extended so as to be closer to a height position of the center of the heater. Thus, the circular-arc length of the rotary shutter 42 can be increased. With this, in a maximum shielding mode of the rotary shutter, that is, in the small size sheet fixing mode, the upper portion of the heater 13*a* can be substantially perfectly covered and shielded with the single rotary shutter 42. As a result, even when the two rotary shutters as described in the eighth embodiment are not used, the advantage of suppressing the temperature rises at the edge portions, which is equivalent to or greater than that in the eighth embodiment, can be obtained.

Meanwhile, the feature of this embodiment is advantageous also in view of heating efficiency. Specifically, the radiant light that spreads to the right and left below the heater 13*a* is reflected by a curved reflecting surface at a central portion in the M-shape of the reflecting plate 41, and then condensed onto a central part of the inner surface of the fixing film 13, which is located above the heater 13*a*. Thus, although the radiant light emitting region in this embodiment is smaller than those in the seventh and eighth embodiments in which the flat reflecting plate is used, due to the condensation effect, the heating efficiency does not deteriorate in comparison with those in the seventh and eighth embodiments, and satisfactory fixing performance can be maintained.

<Tenth Embodiment>

Figure 24A:
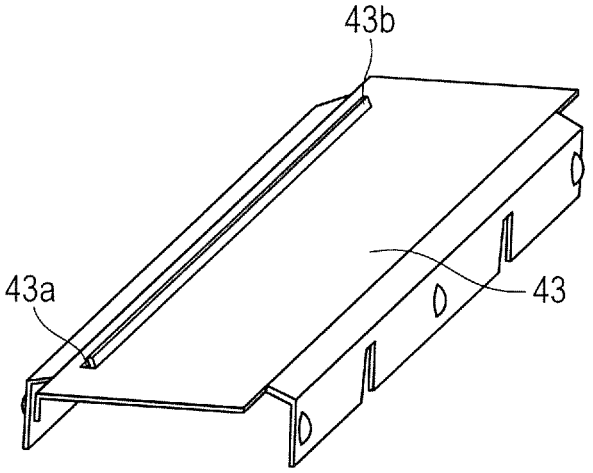
FIG. 24A and FIG. 24B are explanatory views for illustrating a configuration of a reflecting plate according to a tenth embodiment of the present invention.
Figure 24B:
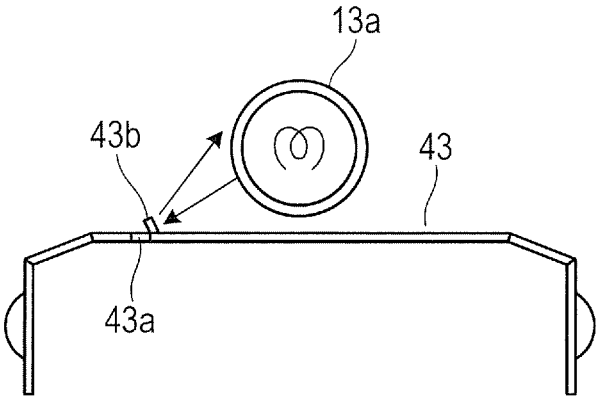

With reference to FIG. 24A and FIG. 24B, a fixing apparatus according to a tenth embodiment of the present invention is described. FIG. 24A and FIG. 24B are schematic views for illustrating a configuration of a reflecting plate 43 of this embodiment. FIG. 24A is a perspective view for illustrating the reflecting plate 43, and FIG. 24B is a sectional view for illustrating a positional relationship between the reflecting plate 43 and the heater 13*a*. In this embodiment, differences from the embodiments described above are mainly described, and the same features as those in the embodiments described above are not described. The fixing apparatus according to this embodiment has the same basic configuration as those of the fixing apparatus according to the seventh, eighth, and ninth embodiments, and is distinguished from the other embodiments in configuration of the reflecting plate.

The embodiments hereinabove are described on a premise that the rotary shutter has a significantly small thickness of approximately 0.3 mm, and a transverse width of the slit of the reflecting plate, which is configured to allow the rotary shutter to pass therethrough, is set to approximately 0.5 mm. A width of the bridge portions formed, for example, in the longitudinal direction of the rotary shutter has an influence on a rotatable angle of the entire shutter, and hence should be set as small as possible. However, as long as the thickness of the shutter is small, in order to maintain an overall rigidity, the width of the bridge portions cannot be reduced. As a result, both the rotatable angle of the shutter and the shielding areas at the edge portions are restricted. In this way, it may be difficult to sufficiently obtain the advantage of suppressing the temperature rises at the edge portions. For this reason, it is more appropriate to increase the thickness of the rotary shutter as much as possible so that the width of the bridge portions is reduced. However, in that case, the transverse width of the slit of the reflecting plate needs to be increased in accordance with the increased thickness of the rotary shutter. As a result, an opening area of the slit is increased, and a considerable amount of the radiant light is absorbed into the opening portion. Consequently, an amount of the radiant light to be reflected by the reflecting plate is reduced, which may cause deficiency in heating and deterioration in heating efficiency of the fixing film.

As a measure for the problem, in this embodiment, the reflecting plate 43 is configured as described later so that, even when a rotary shutter having a larger thickness is used, the radiant light loss to be caused by the opening portion is not increased. First, the reflecting plate 43 is processed so as to have as thin a linear slit as possible. Then, a slit extending portion having a length sufficiently larger than the thickness of the rotary shutter is additionally formed toward the heater 13*a* side so that an L-shape is formed at each end portion of the slit, to thereby form a C-shaped slit. In other words, a process of forming additional slits orthogonal to the slit is executed at both ends of the slit. Note that, in this embodiment, in order to sufficiently secure the overall rigidity even when thin bridge portions are used, the thickness of the rotary shutter is set to 1.0 mm, a thickness of the reflecting plate is set to 0.35 mm, a width of the slit is set to 0.2 mm, and a length of each of the extending portions (additional slits) at both the end portions of the slit is set to 2.0 mm.

Next, in the reflecting plate 43, a part surrounded by the slit and the extending portions at both the ends of the slit is bent upward with respect to the remaining part from a proximal line connecting between distal ends of the extending portions at both the ends of the slit. Through this bending process, not only a slit 43*a* serving as the opening portion that is large enough to allow even a thick shutter to pass therethrough, but also an eaves portion 43*b* configured to block entry of the radiant light from the heater 13*a* into the slit 43*a* is formed. A rising angle of the eaves portion 43*b* is set to an extent that direct entry of the radiant light from the heater 13*a* into the slit 43*a* can be blocked (substantially 120° in this embodiment).

As illustrated in FIG. 24B, with use of the reflecting plate 43 including the eaves portion 43*b* formed in this way, the radiant light emitted from the heater 13*a* toward the slit 43*a* is reflected upward by the eaves portion 43*b*, and hence does not directly enter the slit 43*a*. The radiant light reflected by the eaves portion 43*b* contributes to heating of the fixing film. In other words, even when, in order to use a thick rotary shutter, the opening portion is processed so as to be sufficiently large to allow passage of the rotary shutter (transverse width of the slit of about 2.0 mm), the deficiency in heating and the deterioration in heating efficiency of the fixing film due to the radiant light entering the opening portion can be prevented.

<Eleventh Embodiment>

Figure 25A:
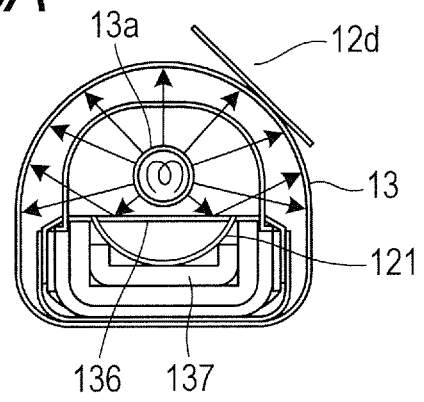
FIG. 25A, FIG. 25B and FIG. 25C are explanatory views for illustrating a configuration of a fixing apparatus according to an eleventh embodiment of the present invention.
Figure 25B:
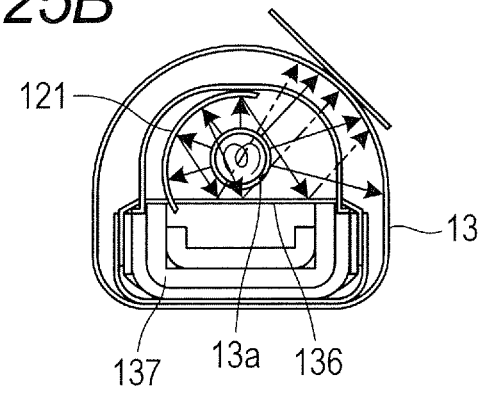
Figure 25C:
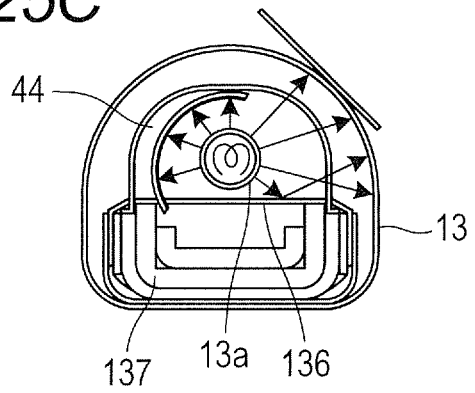

With reference to FIG. 25A to FIG. 25C, a fixing apparatus according to an eleventh embodiment of the present invention, specifically, components in the upper fixing unit are described. In this embodiment, differences from the embodiments described above are mainly described, and the same features as those in the embodiments described above are not described. The fixing apparatus according to this embodiment has the same basic configuration as those of the fixing apparatus according to the seventh, eighth, and ninth embodiments, and is distinguished from the other embodiments in configuration of the reflecting plate.

FIG. 25A is a schematic sectional view for illustrating the upper fixing unit of the seventh embodiment, specifically, illustrating an emission state of the radiant light of the heater under the state in which the rotary shutter 121 is received in the receiving portion. As indicated by the arrows in FIG. 25A, the radiant light of the heater 13*a* is radially emitted around the heater 13*a* being an axial center. The radiant light emitted downward from the heater 13*a* is reflected upward by the reflecting plate 136, and heats the fixing film 13 cooperatively with the radiant light emitted upward from the heater 13*a*.

FIG. 25B is another schematic sectional view for illustrating the upper fixing unit of the seventh embodiment, specifically, illustrating an emission state of the radiant light of the heater under the state in which the rotary shutter 121 is arranged at a light blocking position in the small size sheet fixing mode. As illustrated in FIG. 25B, in the substantially quarter upper left region, the radiant light is not directly emitted onto the edge portions in the longitudinal direction of the inner surface of the fixing film 13. With this, the temperature rises at the edge portions are suppressed. At the central portion in the longitudinal direction of the inner surface of the fixing film 13, the radiant light is not blocked by the rotary shutter 121, and is radially emitted onto the inner surface of the fixing film 13.

In this state, when the specularity of the inner surface of the rotary shutter 121 is high, the radiant light, which is blocked once at the edge portions in the longitudinal direction, may be reflected to the reflecting plate 136 side as indicated by the broken-line arrows in FIG. 25B. This reflected light is further directly reflected on a surface of the reflecting plate 136, and emitted onto the inner surface of the fixing film 13 as indicated by the dashed-dotted arrows in the substantially quarter upper right side in FIG. 25B. The reflected light is emitted doubly with the radiant light emitted from the heater 13*a* directly onto the inner surface of the fixing film 13. Thus, even when radiant light is blocked at the edge portions in the left region in FIG. 25B, the radiant light is reflected and condensed into the right region in FIG. 25B. As a result, further temperature rises may disadvantageously occur at the edge portions. As long as the rotary shutter is formed of a metal material, even when a raw material having a coarse surface is selected, the reflectance of the inner surface cannot be ignored. For this reason, measures to be taken so as to obtain the advantages may be hindered.

FIG. 25C is a schematic sectional view for illustrating the upper fixing unit of the eleventh embodiment of the present invention, specifically, illustrating an emission state of the radiant light of the heater under the state in which a rotary shutter 44 is arranged at the light blocking position in the small size sheet fixing mode. This embodiment has a feature in that the rotary shutter 44 having a blackened inner surface formed through application of an infrared absorbing-black coating on the inner surface is used. With this measure, the radiant light that is blocked at edge portions in a longitudinal direction of the rotary shutter 44 is absorbed by the inner surface of the rotary shutter 44, and hence is scarcely reflected. In this way, such an inefficient situation that the regions at the edge portions, which are shielded once by the rotary shutter, is reheated on the opposite side as a result of multiple reflection by the reflecting plate 136 is improved. Thus, a greater advantage of suppressing the temperature rises at the edge portions can be obtained. Further, by the above-mentioned measure, the radiant light, which is multiple-reflected also by the edge portions, can be prevented from being condensed also onto the halogen heater 13*a*. With this, problems such as shortening of a life of the heater due to a halogen cycle disturbance that may be caused by local temperature differences in the longitudinal direction of the heater 13*a* can be prevented.

<Twelfth Embodiment>

Figure 26A:
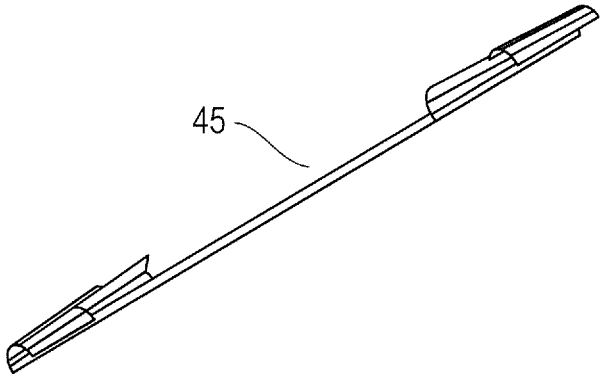
FIG. 26A and FIG. 26B are explanatory views for illustrating a configuration of a reflecting plate according to a twelfth embodiment of the present invention.
Figure 26B:
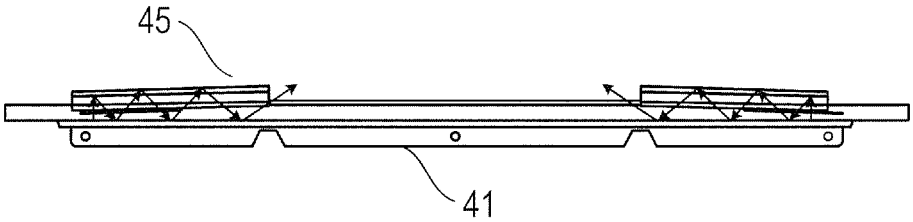

With reference to FIG. 26A and FIG. 26B, a fixing apparatus according to a twelfth embodiment of the present invention is described. FIG. 26A and FIG. 26B are schematic views for illustrating a configuration of a rotary shutter 45 of this embodiment. FIG. 26A is a perspective view, and FIG. 26B is a front view. In this embodiment, differences from the embodiments described above are mainly described, and the same features as those in the embodiments described above are not described. The fixing apparatus according to this embodiment has the same basic configuration as those of the fixing apparatus according to the other embodiments, and is distinguished from the other embodiments in that the rotary shutter is formed so as to be gradually reduced in diameter from a central portion toward edge portions in its rotation axis direction.

As illustrated in FIG. 26A, the rotary shutter 45 is configured so that the radiant light shielding portions at both the edge portions in the longitudinal direction are inclined (tapered) in such a manner that an inner diameter thereof is gradually reduced from the center toward the edge portion (outer shape is gradually thinned). Each of the shielding portions at the edge portions is inclined to such an extent that the radiant light emitted onto the shielding portions can be reflected toward the central portion of the shutter. In this embodiment, each of the shielding portions is processed so as to be tapered at an angle of 5° so as to be expanded toward the central side of the shutter. Further, inner surfaces of the tapered shielding portions are subjected to mirror polishing so that the radiant light can be efficiently reflected.

FIG. 26B is an example of combining the rotary shutter 45 configured as described above with the sectionally M-shaped reflecting plate 41 (ninth embodiment). In FIG. 26B, for the sake of better understanding of the configuration, the heater is not shown. First, at the edge portion of the rotary shutter 45 arranged at the light blocking position in the small size sheet fixing mode, the radiant light is emitted perpendicularly upward from an axial center of the heater as indicated by the leftmost arrow in FIG. 26B. Then, the emitted radiant light is reflected obliquely downward at the angle of 5° toward the center by the tapered inner surface of the shielding portion as indicated by the broken-line arrow. The reflected radiant light is further reflected obliquely upward at the same incident angle toward the center by the reflecting plate 41 as indicated by the dashed-dotted arrow, and then reflected again obliquely downward at the angle of 5° toward the center by the tapered inner surface of the shielding portion again as indicated by the broken-line arrow. By repeating the reflections in this way, the reflected radiant light consequently contributes to heating of the feeding region of the small size sheets. In this way, according to this embodiment, the radiant light emitted onto the non-sheet feeding portions is not merely blocked as in the other embodiments, and can be efficiently utilized so as to contribute to the heating of the sheet feeding portion. With this, a fixing apparatus having a high heating efficiency can be provided.

<Thirteenth Embodiment>

With reference to FIG. 27 and FIG. 28A to FIG. 28D, a fixing apparatus and an image forming apparatus according to a thirteenth embodiment of the present invention are described. In this embodiment, differences from the embodiments described above are mainly described, and the same features as those in the embodiments described above are not described. The fixing apparatus according to this embodiment has the same configuration as those of the fixing apparatus according to the other embodiments, and a feature of this embodiment resides in a method of controlling the fixing apparatus with the control unit of the image forming apparatus. The control of this embodiment is applicable also to the other embodiments described above. A configuration of a control system is the same as that illustrated in FIG. 9B.

Figure 27:
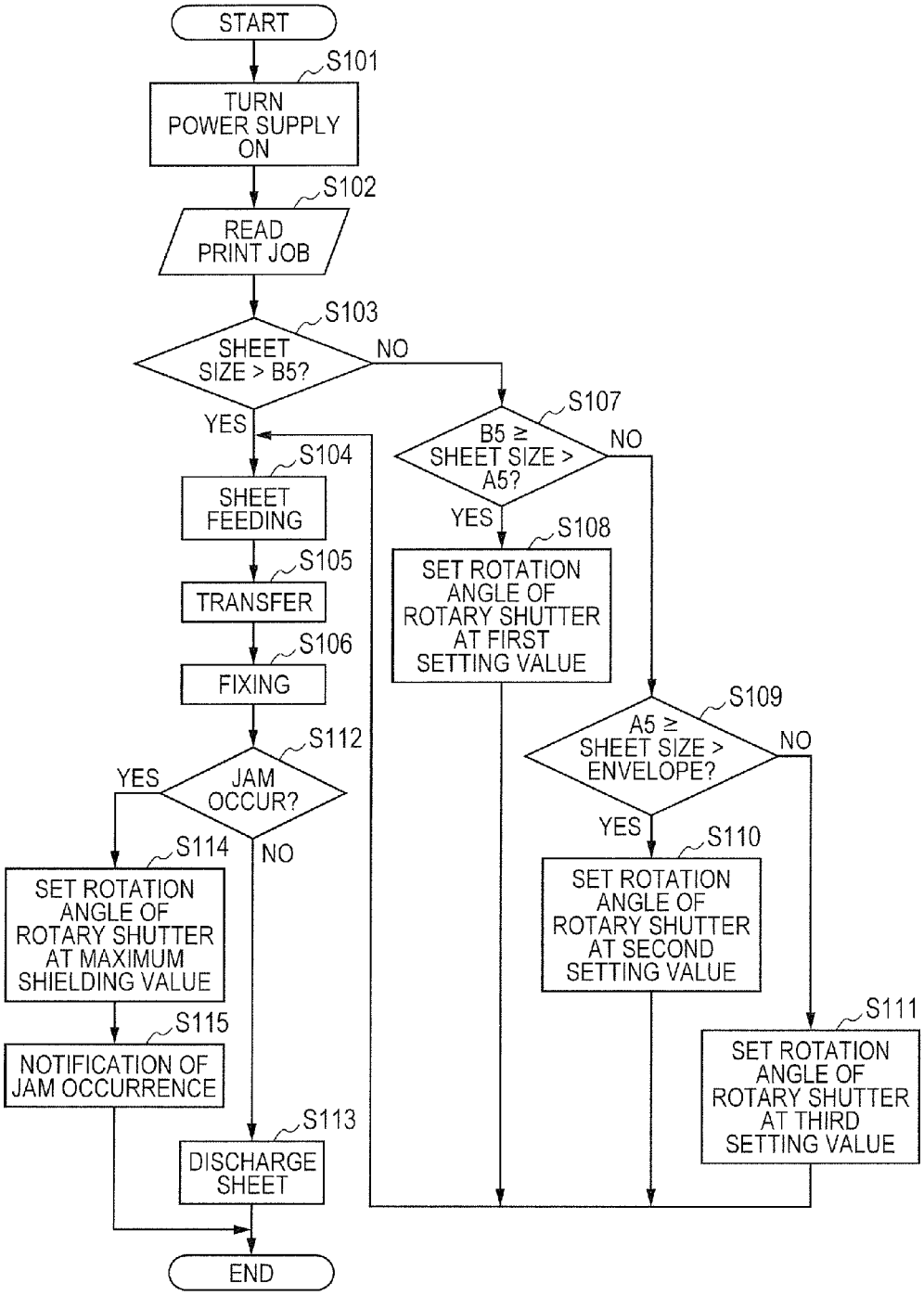
FIG. 27 is a flowchart for illustrating rotary shutter drive control according to a thirteenth embodiment of the present invention.

FIG. 27 is a flowchart for illustrating a method of controlling driving of the rotary shutter according to this embodiment, which is taken as a measure against the temperature rises at the edge portions. FIG. 28A to FIG. 28D are perspective views for illustrating a comparison of internal states of the fixing unit before and after the operation illustrated in the flowchart of FIG. 27, specifically, illustrating shapes of rotary shutters of two types suited to the control of this embodiment. The control of this embodiment is performed so as to prevent one of the problems in the related art, which is described with reference to FIG. 5A and FIG. 5B, specifically, the trouble that the fixing film deformed by the external force applied from a jammed sheet that is deformed in the case of a jam occurrence or by a sheet rolled around the fixing film comes into contact with the heater. This embodiment has a feature in that, as a measure against such trouble, the rotary shutters of the embodiments described above are used, and the rotation angle of the rotary shutter is switched from a normal angle of preventing the temperature rises at the edge portions to an emergency angle based on the flowchart of FIG. 27.

Now, with reference to the flowchart of FIG. 27, how the drive of the rotary shutter is controlled in a case where a printer accepting the A4 size is used as the image forming apparatus according to this embodiment is described.

(1) First, a power supply of the printer is turned on (Step S101).

(2) Then, a print job sent from a host side is read by the control unit (Step S102).

(3) Based on information of the print job, the control unit causes the printer to recognize a size of a sheet to be printed.

(I) When the width of the sheet is larger than a width of B5 size sheets ("YES" in Step S103), the flow proceeds to a sheet feeding step with the rotary shutter being maintained at a normal receiving position (Step S104).

(II) When the width of the sheet is equal to or smaller than the width of the B5 size sheets, and is larger than a width of A5 size sheets ("NO" in Step S103, and "YES" in Step S107), the rotary shutter is rotated to and stopped at a first setting angle (Step S108). Then, the flow proceeds to the sheet feeding step (Step S104).

(III) When the width of the sheet is equal to or smaller than the width of the A5 size sheets, and is larger than a width of COM10 size envelopes ("NO" in Step S103, "NO" in Step S107, and "YES" in Step S109), the rotary shutter is rotated to and stopped at a second setting angle (Step S110). Then, the flow proceeds to the sheet feeding step (Step S104).

(IV) When the width of the sheet is equal to or smaller than the width of COM10 size envelopes ("NO" in Step S103, "NO" in Step S107, and "NO" in Step S109), the rotary shutter is rotated to and stopped at a third setting angle (Step S111). Then, the flow proceeds to the sheet feeding step (Step S104).

(4) After the sheet feeding, the flow proceeds to a transfer step (Step S105), and then to a fixing step (Step S106).

(5) When no jam occurs during the fixing ("NO" in Step S112), the sheet is discharged as it is (Step S113), and then the flow is ended.

(6) When a jam occurs during the fixing ("YES" in Step S112), the CPU 22*b* serving as the control unit configured to control shielding modes of the rotary shutter receives a jam detection signal from the discharge sensor 11 serving as the detection unit. In response to the reception of the jam detection signal, the CPU 22*b* instantly rotates the rotary shutter at a maximum shielding angle (Step S114). Then, the CPU 22*b* issues a jam occurrence notification signal so as to notify a user of the jam occurrence (Step S115). With this, the CPU 22*b* prompts the user to manually remove the jammed sheet, and then the flow is ended.

The angles (phases) to be taken by the rotary shutter for protection of the heater in the case of the occurrence of a jam differ depending on the shutter configurations so that the opposing region between the heater and the fixing film can be shielded over a broadest range in each of the configurations.

Figure 28A:
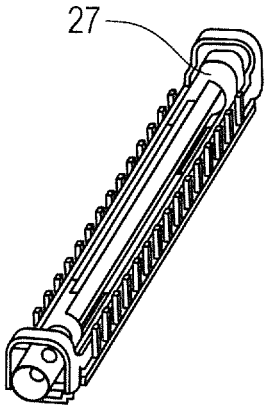
FIG. 28A, FIG. 28B, FIG. 28C and FIG. 28D are explanatory views for illustrating configurations of rotary shutters according to the thirteenth embodiment of the present invention.
Figure 28B:
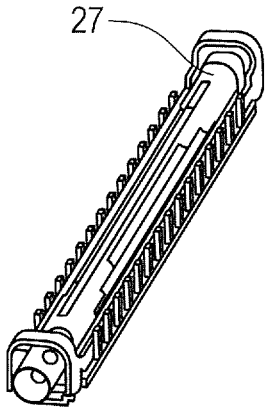

FIG. 28A and FIG. 28B are schematic perspective views for illustrating a maximum shielding angle of the rotary shutter 27 of the fixing apparatus according to the third embodiment, as an example of the most advantageous protective configuration that can be provided by fixing apparatus configured to directly heat the fixing nip portion and to shield the edge portions with a single rotary shutter. As illustrated in FIG. 28A, in the configuration of the third embodiment, the maximum setting angle of the shutter in the COM10 envelope size sheet feeding mode is set to 90° in a clockwise direction from a reference position. Meanwhile, as illustrated in FIG. 28B, in the case of the occurrence of a jam, the rotary shutter 27 is rotated by 180° from the reference position so that the upper portion of the heater can be covered as broadly as possible.

Figure 28C:
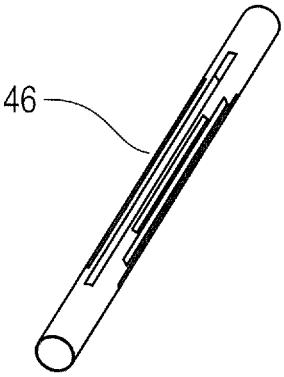
Figure 28D:
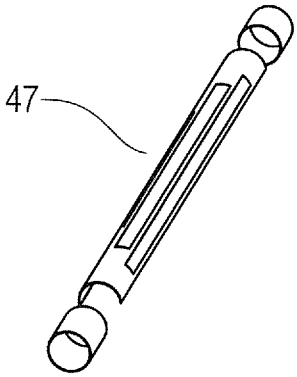

FIG. 28C (FIG. 28D) is a schematic perspective view for illustrating an example of a configuration of a rotary shutter suited to enhance heater protection performance. A rotary shutter 46 of FIG. 28C further includes the bridge portions formed between the cutout parts corresponding to the sheet sizes so as to be suitably used in fixing apparatus configured to heat both the fixing nip portion and the counter-fixing nip portion. A rotary shutter 47 of FIG. 28D also further includes the bridge portions formed between the cutout parts corresponding to the sheet sizes so as to be suitably used in fixing apparatus configured to heat only the counter-fixing nip portion with the reflecting plate. In other words, each of the rotary shutters has such a configuration that the plurality of cutout parts (opening portions) formed in accordance with the sheet sizes are partitioned from each other by the bridge portions. With such a configuration, the heater can be protected over a larger area, and an overall rigidity of the shutter can be increased. Thus, the risk in that the deformed fixing film comes into contact with the heater can be further reduced. As a result, the heater protection performance can be enhanced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-249942, filed Dec. 10, 2014, which is hereby incorporated by reference herein in its entirety.

What is claimed is:

1. A fixing apparatus for fixing a toner image onto a recording material while conveying the recording material bearing the toner image at a nip portion, the fixing apparatus comprising:

a cylindrical film;

a nip portion forming member in contact with an inner surface of the film;

a pressure member configured to form the nip portion with the nip portion forming member through the film;

a heater having a long narrow shape along a longitudinal direction of the film, configured to heat the film by emitting a radiant light, the heater being arranged in a hollow portion of the film;

a first shielding member configured to shield the nip portion forming member from the radiant light emitted by the heater, the first shielding member being arranged between the nip portion forming member and the heater; and a second shielding member having a cutout, configured to be rotatable around the heater between a first position and a second position, the first position being at an opposite side to the heater across the first shielding member when viewed in a longitudinal direction of the heater, the second position being different from the first position in a rotating direction of the film when viewed in the longitudinal direction of the heater so that the radiant light passing through the cutout of the second shielding member heats the film, wherein, when the second shielding member is positioned at the second position, a longitudinal width of a region of the film receiving the radiant light through the cutout is smaller than a longitudinal width of a region receiving the radiant light not through the cutout when the second shielding member is positioned at the first position.

2. The fixing apparatus according to claim 1, wherein the second shielding member has a circular-arc shape in cross-section when viewed in the longitudinal direction of the film, and is configured to be rotatable around the heater.

3. The fixing apparatus according to claim 1, wherein the cutout of the second shielding member comprises a plurality of cutouts that are different from each other in width in the longitudinal direction of the film, and are arranged along the rotating direction of the film.

4. The fixing apparatus according to claim 1, wherein the nip portion forming member includes a stay which has a U-shape in a cross-section perpendicular to the longitudinal direction of the film, and is arranged such that an opening portion of the U-shape faces the heater.

5. A fixing apparatus for fixing a toner image onto a recording material while conveying the recording material bearing the toner image at a nip portion, the fixing apparatus comprising:

a cylindrical film;

a nip portion forming member in contact with an inner surface of the film;

a pressure member configured to form the nip portion with the nip portion forming member through the film;

a heater having a long narrow shape along a longitudinal direction of the film, configured to heat the film by emitting a radiant light, the heater being arranged in a hollow portion of the film;

a first shielding member configured to shield the nip portion forming member from the radiant light emitted by the heater, the first shielding member being arranged between the nip portion forming member and the heater; and a second shielding member having a cutout, configured to be rotatable around the heater between a first position and a second position, the first position being at an opposite side to the heater across the first shielding member when viewed in a longitudinal direction of the heater, the second position being different from the first position in a rotating direction of the film when viewed in the longitudinal direction of the heater so that the radiant light passing through the cutout of the second shielding member heats the film, wherein the second shielding member is positioned at the first position when the recording material having a maximum width of the recording material available in the apparatus is conveyed at the nip portion, and wherein the second shielding member is positioned at the second position when the recording material having a narrower width than the maximum width is conveyed at the nip portion.

6. The fixing apparatus according to claim 1, wherein a longitudinal width of the cutout of the second shielding member is narrower than a maximum width of the recording material available in the apparatus.

7. A fixing apparatus for fixing a toner image onto a recording material while conveying the recording material bearing the toner image at a nip portion, the fixing apparatus comprising:

a cylindrical film;

a nip portion forming member in contact with an inner surface of the film;

a pressure member configured to form the nip portion with the nip portion forming member through the film;

a heater having a long narrow shape along a longitudinal direction of the film, configured to heat the film by emitting a radiant light, the heater being arranged in a hollow portion of the film;

a first shielding member configured to shield the nip portion forming member from the radiant light emitted by the heater, the first shielding member being arranged between the nip portion forming member and the heater;

a second shielding member having a cutout, configured to be rotatable around the heater between a first position and a second position, the first position being at an opposite side to the heater across the first shielding member when viewed in a longitudinal direction of the heater, the second position being different from the first position in a rotating direction of the film when viewed in the longitudinal direction of the heater so that the radiant light passing through the cutout of the second shielding member heats the film; and a third shielding member having a cutout, configured to be rotatable around the heater between a third position and a fourth position, the third position being at an opposite side to the heater across the first shielding member when viewed in the longitudinal direction of the heater, the fourth position being different from the third position and the second position in the rotating direction of the film when viewed in the longitudinal direction of the heater so that the radiant light passing through the cutout of the third shielding member heats the film, wherein the third shielding member positioned at the third position and the second shielding member positioned at the first position overlap with each other in the rotating direction of the film when viewed in the longitudinal direction of the heater.

8. The fixing apparatus according to claim 7, wherein, when the recording material having a minimum width of the recording material available in the apparatus is conveyed at the nip portion, the second shielding member is positioned at the second position and the third shielding member is positioned at the fourth position.

9. The fixing apparatus according to claim 7, wherein the first shielding member, the second shielding member positioned at the second position, and the third shielding member positioned at the fourth position cover an entire periphery of the heater.

* * * * *